US008092210B2

(12) United States Patent
López Sánchez

(10) Patent No.: US 8,092,210 B2
(45) Date of Patent: Jan. 10, 2012

(54) MOLD FOR PRODUCING DOOR CORES

(76) Inventor: Manuel López Sánchez, Curtis (ES)

( * ) Notice: Subject to any disclaimer, the term of this patent is extended or adjusted under 35 U.S.C. 154(b) by 333 days.

(21) Appl. No.: 12/227,161

(22) PCT Filed: May 18, 2007

(86) PCT No.: PCT/ES2007/000290
§ 371 (c)(1),
(2), (4) Date: Feb. 12, 2009

(87) PCT Pub. No.: WO2007/135211
PCT Pub. Date: Nov. 29, 2007

(65) Prior Publication Data

US 2009/0165961 A1 Jul. 2, 2009

(30) Foreign Application Priority Data

May 19, 2006 (ES) ..... 200601305
Oct. 9, 2006 (ES) ..... 200602572
May 14, 2007 (ES) ..... 200701308

(51) Int. Cl.
*B27N 3/20* (2006.01)

(52) U.S. Cl. ..... 425/408; 249/161; 249/180; 425/395; 425/398; 425/411

(58) Field of Classification Search ..... 425/356, 425/395, 398, 408, 411, 422, 441, 443; 249/155, 249/161, 180, 184
See application file for complete search history.

(56) References Cited

U.S. PATENT DOCUMENTS 2,280,359 A * 4/1942 Trudell ..... 72/60
2,410,888 A * 11/1946 Lucy ..... 264/219
(Continued)

FOREIGN PATENT DOCUMENTS

WO 2005/046950 5/2005

OTHER PUBLICATIONS

International Search Report issued Sep. 27, 2007 in the International (PCT) Application of which the present application is the U.S. National Stage.

*Primary Examiner* — Yogendra Gupta
*Assistant Examiner* — Emmanuel S Luk
(74) *Attorney, Agent, or Firm* — Wenderoth, Lind & Ponack, L.L.P.

(57) ABSTRACT

Especially when it is necessary to provide voids (29) for panelling or glazing and a material formed by wood and glue conglomerate particles in one or three layers. These materials are received in separate metering devices that are able to move over a bench, being placed over the mould in accordance with a specific sequence of discharge and movements. It is defined by a fixed perimeter frame (10, 32) with apertures (12, 33) of the dimensions of the door, in which slides, snugly, a first framework (11, 34) and a second framework (14, 35) that can be moved inside the first framework and whose hollow is occupied by a series of pads or blocks (21, 22, 36, 37, 38) that can move independently through the action of respective cylinders (39, 40, 41) in order to occupy the raised position, forming the voids (15, 16, 29) for panelling or glazing, if any. The fixed frame (10, 32) has a moveable interior part (78) for producing oversized doors.

20 Claims, 30 Drawing Sheets

A-A

U.S. PATENT DOCUMENTS

| | | | | | |
|---|---|---|---|---|---|
| 3,166,617 | A | * | 1/1965 | Munk | 264/109 |
| 3,534,439 | A | | 10/1970 | Haas et al. | |
| 5,100,601 | A | | 3/1992 | Heggenstaller et al. | |
| 5,192,560 | A | | 3/1993 | Umetsu et al. | |
| 5,738,345 | A | * | 4/1998 | Schroeder et al. | 269/266 |
| 5,796,620 | A | * | 8/1998 | Laskowski et al. | 700/197 |
| 5,879,612 | A | * | 3/1999 | Zeiter et al. | 264/292 |
| 5,954,175 | A | * | 9/1999 | Haas et al. | 192/48.2 |
| 6,012,314 | A | * | 1/2000 | Sullivan et al. | 72/14.8 |
| 6,230,409 | B1 | | 5/2001 | Billings et al. | |
| 7,159,836 | B2 | * | 1/2007 | Parks et al. | 249/155 |
| 7,255,550 | B2 | * | 8/2007 | Chiang | 425/193 |
| 7,311,512 | B2 | * | 12/2007 | Yanagisawa et al. | 425/385 |
| 7,395,844 | B2 | * | 7/2008 | Suzuki | 144/361 |
| 2008/0251975 | A1 | * | 10/2008 | Gallagher et al. | 264/571 |

* cited by examiner

A-A

B-B

C

D-D

E-E

MOLD FOR PRODUCING DOOR CORES

OBJECT OF THE INVENTION

As stated in the title of this descriptive specification, the present invention relates to a mold (or mould) for producing door cores, which includes notable advantageous characteristics for that door manufacturing system and especially when the doors have to include voids for paneling or glazing of a known shape, number and distribution.

The door cores are formed by pressing a mat of wood and glue conglomerate particles coming from the formers, in a gantry press with hot plates until the standard final thickness of the doors is achieved. They are then edged and, following a process of smoothing down, the laminas of fine wood that define the visible faces of the door are glued on.

The conglomerate of wood particles and glue with which the door core is formed is not uniform but instead normally presents a sandwich-like structure, consisting of a central layer with a larger particle size, lower density and of greater thickness than the two outer layers which have finer particles, greater density and are less thick than the central layer. If the material used is DM, a single former is employed.

It is an object of the invention to make it possible to automatically manufacture the door cores of different standard thicknesses, as well as to vary the shape, number and distribution of the voids for paneling or glazing.

It is also an object of the invention for the periphery of the mould to receive a larger amount of wood and glue conglomerate than the rest, which makes it possible to achieve a greater density in that perimeter zone when compacting or pressing, which would even mean that it is not necessary to fit the glued thick edges in a later operation which are usually added in order to provide rigidity for the peripheral zone, particularly in the longitudinal or vertical borders which are the ones that have to receive the fittings both for the hinges and for the lock assembly. On the contrary to this, and due to this peripheral zone of the door core obtained by this system of molding being very compact, it is merely necessary to carry out the edging in order to equalize the quality of the visible materials made of fine wood in aesthetic terms, so that the door appears to be made of solid wood having the nature of the laminas. If the structure is that of a sandwich, a greater quantity of material of the middle layer of it is used.

BACKGROUND OF THE INVENTION

Nowadays, conglomerate boards are manufactured in a continuous process by means of formers which pour a first layer of product of greater density and smaller size particles of the wood, mixed with glue and other active products, onto the band of a conveyor belt. A second layer is added to this layer, of greater thickness, lower density and smaller size particles, and finally another layer is added analogous to the first, poured on with another former, producing a sandwich arrangement. This mat of wood and glue particles can consist of a single size of particle, with a uniform composition, including of a known material such as DM.

Independently of the structure and composition of the mat that will be formed following the pressing of the board to the required thickness of the door, it initially has a thickness of the order of 90-170 mm which is poured onto the conveyor belt and, once pressed in the hot plate press, a thickness is obtained is of the order of 25-40 mm for standard doors.

It is then cut up by the manufacturer of the boards to the measurement provided by the door manufacturer, with the aim of easing the difficulty of movements and transportation owing to the large dimension of the boards obtained.

The door manufacturer cuts these boards and machines them in order to produce doors of the desired measurements, eliminating the portions corresponding to the voids which have to be paneled or glazed.

Invention patent P-200501869 claims a manufacturing system for conglomerate boards for doors, with the simultaneous formation of the voids for paneling or glazing, where the mat coming from one or three formers, depending on whether it has a constant density or consists of three layers of different densities with a sandwich type structure, is received on trays or moulds whose width preferably corresponds to the length of the doors to form and whose length is equivalent to a multiple of the width of the latter, with the particular feature that the bottom of the tray possesses apertures in correspondence with the soffits or voids which then have to be paneled or glazed, of equivalent dimensions.

The mould or tray includes some telescopic formwork in the contour of each aperture which provides a retractable characteristic so that the mat of wood and glue conglomerate particles can be received at an initial height prior to pressing, and which permits the difference in thicknesses to be absorbed as far as the thickness that it has to have after the compaction of the two hot plates of the gantry press in which the pressing or compaction is conventionally carried out.

The portions of mat or particles mixed with glue that filled those voids fall through the apertures, and are collected by a lower belt for being reused since they are sent directly to the corresponding hoppers for the formers.

In the installation and according to this invention patent that is cited, there exists an elevator feed device for the trays, which advances on a conveyor belt and continually passes below the formers which discharge the product onto these trays. They then advance towards the cold pre-pressing post where the thickness of the mat is reduced to approximately half and the air is expelled. By means of another elevator the trays are fed to the gap of the hot plate press and they are then collected by another elevator which leads them to the mould stripping post.

In a first Certificate of Addition to this main invention patent that is cited, the structure of the actual tray and its guide system in the pressing station were improved and simplified. The retractable formwork was materialized in the form of a simple triangular piece and the elastic deflector lamina, which used to exist in the main invention patent, perfectly absorbing the thicknesses of the mat of conglomerate particles and glue before and after the pressing.

In the second Certificate of Addition to this main invention patent that is cited, some improvements were contributed consisting of providing some supports in the front edge of the trays, these supports having an extension by way of a hook which is linked by a tooth provided in the hauling chains for the multiple charger and discharger of the press, in the different levels which the hot plates of that press have. Fitted to the rear support of the tray are also other supports with an emerging pad where the hook corresponding to the front part of the adjacent rear tray will link. The press is charged with new trays at the same time as the already pressed ones exit. There exists a charger for the trays which receives them one at a time from the pre-press and ascends as the trays are received until the charge is complete. Both the charger and the discharger include pairs of conveyor chains on which the trays rest for each level of the press and are supported on a bridge structure which slides on roller tracks with hydraulic action in order to produce the connection of the trays of the charger with those of the press and for connecting the discharger with those of the pre-press, respectively.

DESCRIPTION OF THE INVENTION

In general terms, the mould for producing door cores constituting the object of the invention has special application in the production of door cores which have to possess voids for paneling or glazing, these voids being of predefined dimensions, number and position. It has the special characteristic that no material is wasted in the manufacture, or at least it does not have to be redirected towards the hoppers of the formers for being reused, since the door core remains perfectly terminated and finished, lacking just the final laminating, without requiring any machining. On receiving the different layers of the sandwich which has to be formed, or a single layer in the case of using DM material, in a mould in which it is also pressed, the periphery of the door core also receives a greater quantity of conglomerate for its middle layer than in the rest, therefore, when compacted or pressed, a greater density is achieved which means that it is not even necessary to carry out a later operation for gluing the thick edges in place that are conventionally added for providing rigidity to the peripheral zone (above all in the longitudinal or vertical borders which are the ones that are going to receive the fittings both for the hinges and for the lock assembly). All that is necessary is to carry out the edging in order to equalize the quality of the visible materials made of fine wood in aesthetic terms, so that the door appears to be made of solid wood.

In accordance with the invention, the manufacturing line includes two formers which hold the conglomerate of wood particles and glue in the two densities and size of particles which are needed for forming the sandwich or structure of the door core, as commented on earlier.

The formers discharge the product in separate metering devices of the gear type or similar, in which the material is received weighed and/or metered, with a certain height of level and distribution.

The metering devices include separate container vessels for the product and are able to move linearly on the bench for being filled up with product, being able to advance as far as being situated above the mould which occupies a fixed position at all times, with certain sequences of advance and retrocession in combination with the descent movements of the bottom of the mould in order to comply with the objective provided for, as we will comment on further below.

The mould is formed from a fixed perimeter frame which follows the contour of the door core, or a multiple of the surface of the latter in order to obtain several door cores in the same molding phase and separate them afterwards by means of cutting. The height of that perimeter frame is greater than the thickness of the door core prior to compacting, in other words, it exceeds the height of the mat prior to compacting.

On a horizontal platform situated in the lower part of said perimeter frame and which is able to move vertically by means of some hydraulic cylinders, there rests a first rectangular framework, integral with the same, and which fits the dimensions of the void of the perimeter frame and can slide in its interior in the manner of a plunger, whose surface includes as many apertures as there are door cores that can be produced in the mould and which are simultaneously obtained. The dimensions of these apertures are naturally smaller than the dimensions of the door core though their borders are recessed with respect to those of the latter, these apertures remaining in a concentric position with respect to the rectangular contour of them and sliding from a lower position in which the product will be received from the formers in an uncompacted thickness for filling the mould, up to another elevated position for compacting the product so that it is left with the thickness corresponding to that of the standard doors, when the press is hydraulically operated.

There exists one or more second rectangular frameworks independent of each other though they can be moved telescopically inside each of the apertures of the first rectangular framework and which present the form of the surface remaining from the door core, including the respective voids if there are any for paneling or glazing, these second frameworks also being operated by hydraulic cylinders and having the same height as the first framework.

Finally, there exists a vertically moveable upper plate that constitutes the hot plate for the press, which is hydraulically operated in order to close the mould when contact is made with the fixed perimeter frame.

When the door core has to include voids for paneling or glazing, the surface that they occupy is filled with respective blocks which remain fixed in a position flush with the fixed perimeter frame, having the same height as the latter and of such form that the second rectangular frameworks are telescopically guided in its walls.

The first rectangular frameworks or the second rectangular framework or frameworks are hydraulically operated and constitute by themselves the lower hot plate of the press, according to a pressing which we can call conventional since when the mat is compacted it is pressed between the two hot plates: upper and lower.

This lower plate has the form of the surface that is going to receive the product, with the dimensions and geometric arrangement for forming the door core or cores according to a multiple surface of the first and which will be cut up after stripping the mould, as we have stated above.

In the case of the special application of the invention, which is when the door includes the voids for paneling or glazing, the second rectangular framework or frameworks include the said voids and, as they can move vertically, so their surface has to be kept constantly covered by means of the respective fixed block, mentioned earlier. If the door is compact, in other words, without any voids for paneling or glazing, the second framework is solid and its entire surface will receive the layers of conglomerate and glue.

Thanks to the fact that the rectangular frameworks can be moved indistinctly, they can do so in different travels. The first framework is staggered with respect to the second rectangular framework or frameworks, descending by a greater degree to receive a greater quantity of product and in such a way that, when compacted in the press, a greater density is achieved in this perimeter zone as we have stated earlier.

The upper hot plate of the press and the telescopic frameworks which materialize the lower hot plate thereof, on which the particles of wood conglomerate and glue lie, can, as well as including the conventional heating system for melting the urea-formaldehyde glues that are mixed with the particles of wood, furthermore incorporate some outlet nozzles for hot air or steam, which improves the quality of the sandwich and also manages to reduce the setting time. With this same end, the perimeter frame and the fixed blocks that are located in the position of the voids for paneling or glazing also incorporate a heating system similar to that for the hot plates of the press.

The upper hot plate which, throughout the entire process of charging the mould with the different products for forming the sandwich, has remained raised in order to permit the entrance and exit of the metering trays which have previously been charged with the respective product by means of the two metering devices, finally descend in order to close the mould on top. The charging of product has been effected in three phases as we will see further below in relation to the drawings, so that the three layers of the sandwich can be formed. It is starting from the moment in which the mould is closed on top that the first and second rectangular telescopic frameworks are elevated when the lower horizontal platform does so, though with the particular feature that as they advance to effect the pressing, their staggering become reduced until they are flush with each other, continuing like that until they end their travel in order to obtain a sandwich of uniform thickness but with greater density in the periphery of each of the doors obtained in a single pressing, though the board is then cut with a saw so that the different door cores are separated from each other.

The stripping of the mould is easily carried out after the setting time by raising up the upper hot plate and then continuing the advance of the lower platform, until the pressed board exits from the mould.

Certain improvements have been provided in this structure in order to achieve the aims, mentioned earlier, of automatism and versatility in the manufacture of different types and models of door.

The mould has a rectangular frame or perimeter wall which possesses different hollows or apertures with the contour of the door core to be manufactured in order to simultaneously produce several fully finished units, defining a composite mould, though it could also be a simple mould for manufacturing them on a unitary basis. Nevertheless, the previous arrangement is much more profitable.

Sliding vertically in each of these independent hollows or apertures is a first rectangular framework with the contour of the door. Able to move telescopically inside it is a second rectangular framework whose inner hollow is in turn occupied by a series of blocks that can move individually, and which can have the same or different size. These blocks can move simultaneously with the second rectangular framework, being flush with it, in order to obtain solid door cores. If any of them is kept in the elevated position during the process of charging and compaction of the mat, the voids for paneling and glazing will be formed.

The useful surface of the first rectangular framework defines the zone where a greatest quantity of product will be received and that of the second rectangular framework defines the remaining zone of the door which is extended to the sliding blocks or pads that have not been elevated and on which the mat of wooden and glue conglomerate particles will also be deposited.

The rectangular framework or perimeter wall of the mould rests on a robust perimetric structure that includes wheels for facilitating its movement on a pair of rails provided on the ground and intended for being able to extract the entire mould from its work place in which it is located in the press, so that it can then be easily repaired and maintained. When it returns to its original position the assembly is raised up slightly in order to proceed to remove it from its wheels so that it seats perfectly on the rails.

Both the first rectangular framework, and the second rectangular framework, along with the independent intermediate pads with which the voids can be formed form paneling or glazing, are supported by vertical rods which pass through an upper horizontal thrust platform which is operated by the hydraulic cylinders for effecting the pressing as we will see later on. The lower ends of these rods rest on a moveable framework of adjustable height with which it is possible to vary the height of charging since underneath it possesses certain wheels that slide in some wedges of a framework that is displaceable in the horizontal direction by being supported on other wheels connected to the lower part of the perimetric structure, this being a movement that takes place by means of a motor and a rack and pinion device.

The length of the support rods for the first rectangular framework is less than those for the second rectangular framework, the latter being equal to the support rods for the pads because they are flush with the latter rectangular framework. This staggering between the rectangular frameworks determines the greater thickness of charge in the perimeter zone of the door. This difference in level can be varied simply by locating some shims in the support base for the vertical rods, increasing or reducing their number.

In order to be able to raise the corresponding pads so as to form the voids for paneling or glazing, all of them in turn rest on the rod of a respective hydraulic cylinder which rests on a longitudinal metal strip that is central with respect to the surface of each door. These support bars of the hydraulic cylinders are provided in respective columns which rest on horizontal bars fixed to the ground.

The rods of those cylinders are connected to each block or pad in order to be able to raise or lower it according to the type, shape and distribution of the void or voids to form for paneling or glazing, these rods passing through the upper thrust platform, just like the vertical rods.

The first and second frameworks are merely supported by four rods arranged in the corner zones since they only have to bear the actual weight of the framework and of the charge of product, given that the compaction pressure is produced by the upper platform via some thrusting pads attached to its active face, all of them of the same height and facing each of the first and second rectangular frameworks. These thrusting pads also exist in correspondence with the portions or pads forming the voids for paneling or glazing. Instead of the upper thrust platform being in direct contact with the frameworks and pads, the thrusting pads are situated in order to thereby form a void underneath them so as to permit the cleaning and removal of remains that might have become encrusted.

When the upper thrust platform is raised in order to start the compaction, it is the first framework that rises up first, or more accurately the first frameworks that the composite mould includes (eight by number in order to optimize the production), until it becomes flush with the second framework or frameworks, at which moment the corresponding thrusting pads establish contact with the second rectangular frameworks and they therefore rise up simultaneously. During this small travel of staggering the compaction or pressing takes place of the perimeter zone of the door core, in each of the apertures of the composite mould and so greater density is obtained as was sought. Naturally, in the compaction process the mould has to remain covered with the hot plate of the press, once the metering devices used for charging the mould have been withdrawn.

The pads forming the voids for paneling or glazing are kept at an upper level flush with the mould of the mould, while the other ones at all times accompany the second or interior rectangular framework of the telescopic unit.

Certain improvements are considered both in the fixed part of the mould and in the raising and lowering structure of the first and second frameworks, which is simplified in order to vary the displacement travel, depending on the different thicknesses of the door cores.

First of all, it can be mentioned that the rectangular framework with which several units are produced in the same pressing cycle, instead of being fixed for manufacturing standard door cores, is divided into two parts; a fixed outer part perimetric to each independent unit and the other moveable inner part which can be telescopically displaced inside that unit and able to occupy two positions: an upper one which keeps it flush with the outer perimetric part for producing standard door cores and another lower position for manufacturing door cores of larger dimensions in terms of length and width, by descending by the same measure as does the first rectangular framework in order to receive a greater volume of material to press.

Moreover, the outer fixed perimetric part of each independent unit has its longitudinal walls provided with separate moveable metal strips which can descend to a greater or equal degree as does the inner moveable part in order to manufacture door cores that are oversized by one third in width, also receiving a greater charge of material to press. These latter doors are widely used as passage doors in hospitals.

Both the moveable metal strips and the inner perimetric part are supported on vertical rods which are in turn supported on the cross-members of individual frameworks that are independent for the different units of the mould and aided by some first hydraulic cylinders and some second hydraulic cylinders for independent movements linked to the charging of product, depending on the position occupied by the metering devices for the products forming the sandwich.

The metal strips and the moveable inner perimetric part can occupy the lowest and in turn staggered position of the first and second frameworks in order to receive a greater charge of product for forming cores of oversized doors, simply by causing the hydraulic cylinders aiding them to extend or withdraw to the desired degree depending on the order received from the automatic computer-controlled unit. The admission movements (descent) are sequential during the advance of the metering devices as we will see further below, since in the displacement towards one side the product for the two layers of the sandwich is discharged. When the moveable framework in which the metering devices are situated exits from the press, the pressing is then carried out and so when it returns to the other side the withdrawal of the door cores takes place simultaneously, once the upper plate of the press has been raised and the lower cylinders of it have extended in order to remove the door core from the mould.

During this return travel, the moulds are being sequentially filled in the same way as mentioned earlier, then proceeding to the pressing and extraction of the door cores for a new cycle.

Another of the cited improvements forming the object of this invention consists of simplifying the elevation and descent mechanisms of the first and second frameworks of the earlier form of doing this for the production of standard door cores, or which move together with the moveable part of the perimeter framework in the case of producing doors that are oversized in width and height, without any need for there to exist moveable frameworks with wheels that are driven by the ramps of the laterally displaceable framework, since provision has been made so that it is sufficient for the hydraulic cylinders to be moved by automatic control, in which the travel is extremely precise.

Another improvement considered by the invention is a novel structure for the metering device which carries out the advance movements (charging all the units of the mould in the press), it then halts outside of the press so that the pressing can take place, returns to the other side with the simultaneous filling of the moulds, is stopped on this side so that the pressing can taken place, and so on successively.

The metering device includes a large central hopper with the product that is going to constitute the central part of the sandwich, and another two smaller side hoppers containing the product for its outer layers.

At the bottom of the hoppers are some rotating rollers with blades on which the wood and glue conglomerate lies for filling the mould according to the programmed sequences. As the central hopper contains a far greater quantity of product to discharge in the mould than do the side hoppers, the bottom is occupied by two conveyor belts which advance towards the centre where three blade rollers are found. There also exists two conveyors that are transverse to the advance movement of these side conveyor belts which move the product helping to achieve a uniform distribution in the mould.

In the forward and rear part of the carrier framework for the metering devices, there are some double cleaner rollers. The inner ones are arranged obliquely in order to effect a better sweeping and smoothing of the layer poured into the mould, as we will see later on in relation to the drawings.

In order to facilitate a better understanding of the characteristics of the invention and forming an integral part of this descriptive specification, some sheets of plans are attached in which, by way of illustration and non-limiting, the following has been represented:

DESCRIPTION OF THE PREFERRED FORM OF EMBODIMENT

Figure 1:
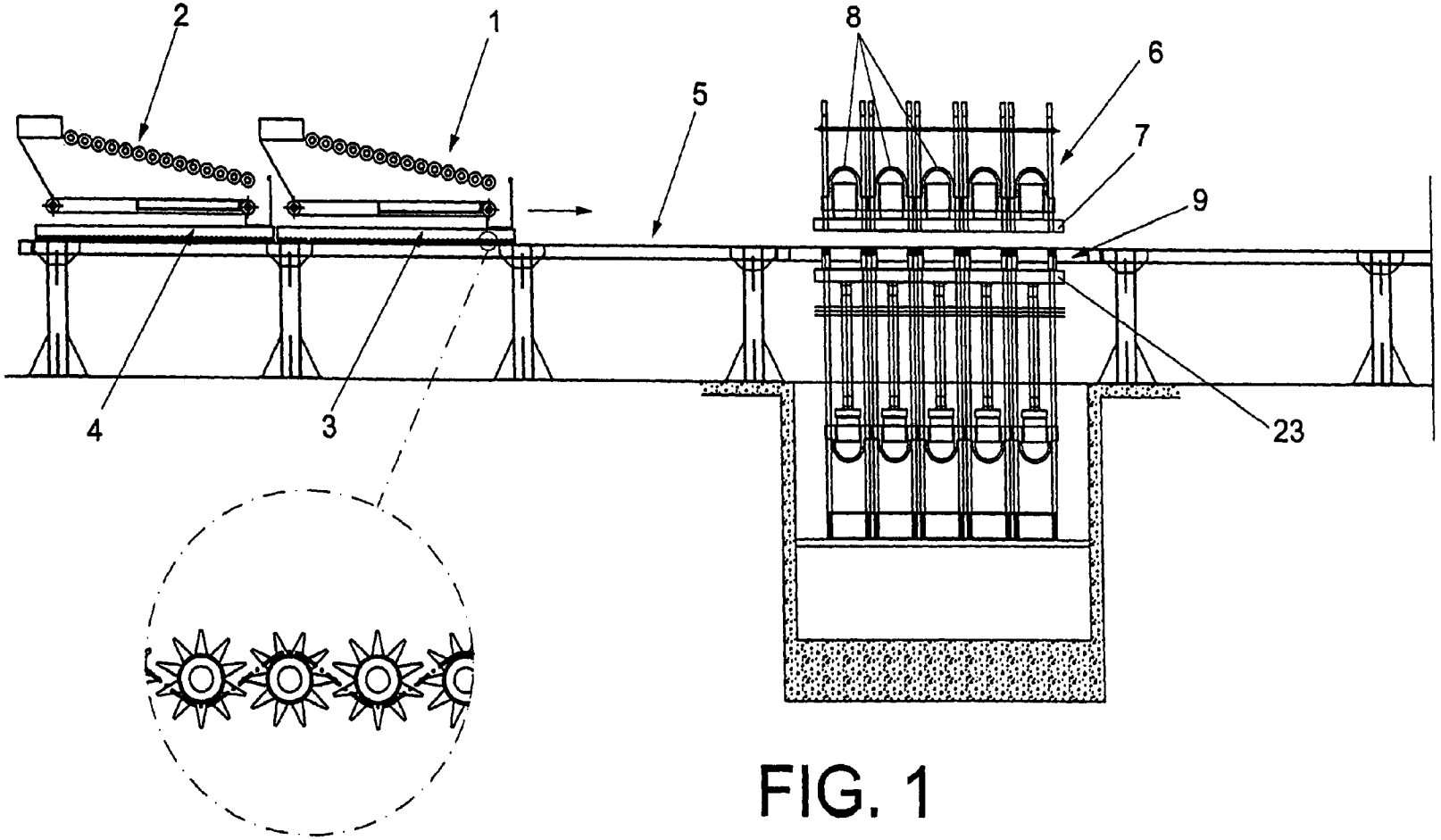
FIG. 1. Is a schematic view of an installation for the production of door cores with the system forming the object of the invention.

Making reference to the numbering adopted in FIGS. 1 to 5, and especially in relation to FIG. 1, the mould for producing door cores which the invention proposes starts from the use of the two formers 1 and 2 in which the wood and glue conglomerate is found according to the two densities and particle sizes mixed with the urea-formaldehyde glues: in the former 1 is the component of greater density which will occupy the outer layers of the sandwich of the board for the door core and in the former 2 is the component of lesser density which will remain in the central part of the board.

The formers 1 and 2 are located at fixed points and the charge of the respective metering devices 3 and 4 is effected by displacing the latter since they can advance on the bench 5. Both metering devices 3 and 4 are connected linearly and can be situated inside the press 6 on the mould that has to be filled, first with the part of the product supplied by the metering device 3, then it will receive the content of the metering device 4 and finally the rest of the product of the metering device 3 will be discharged into the mould, thereby forming a sandwich, these movements being combined with the programmed descents of the moveable base of the mould.

The press 6 includes the upper hot plate 7 which can be moved vertically with hydraulic cylinders 8 closing the mould 9 in which the product is sequentially received from the metering devices 3 and 4.

Figure 2:
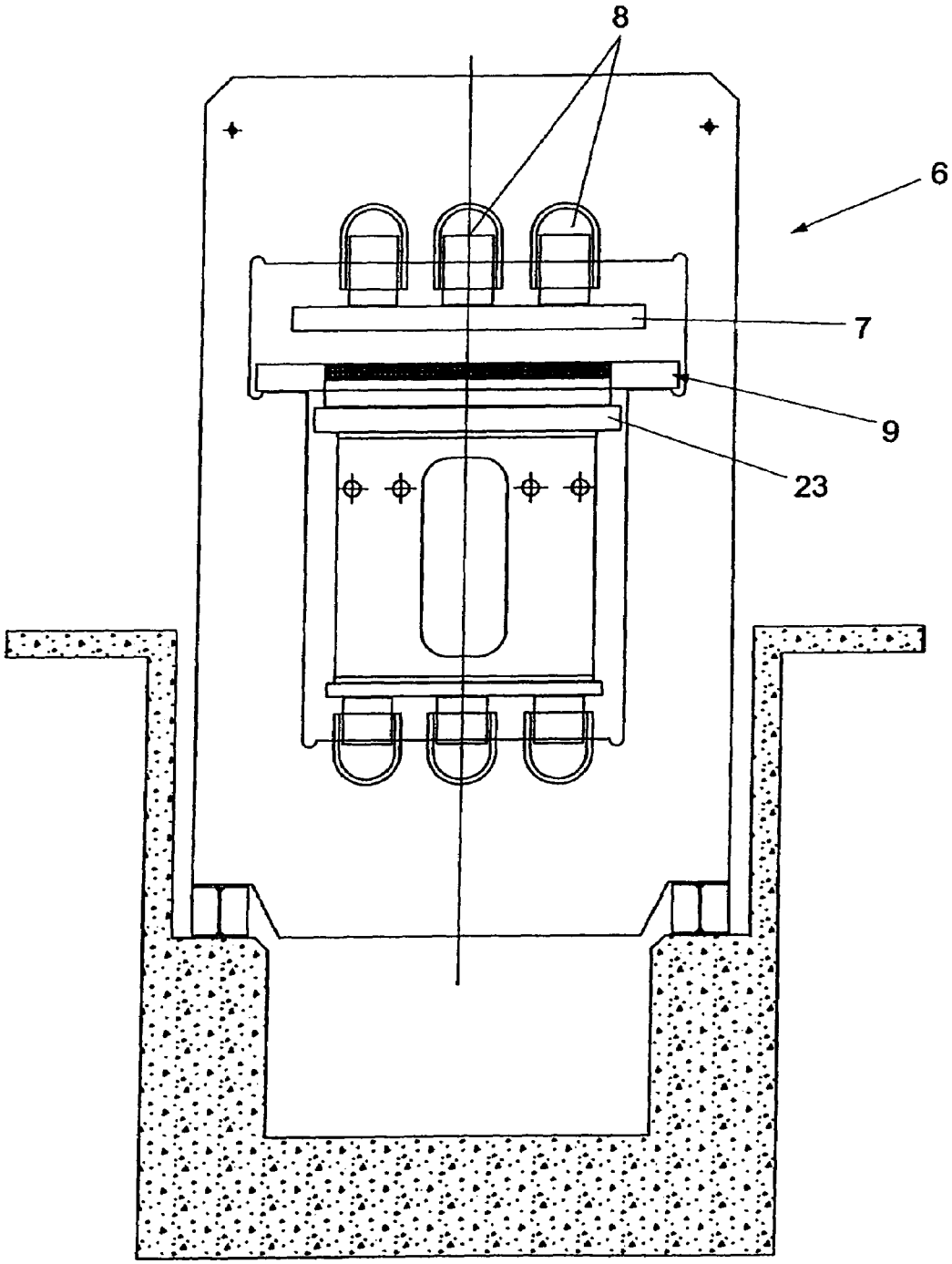
FIG. 2. Is a side-on view in elevation of the same press used in the installation of FIG. 1.

In FIG. 2 the press 6 can be seen in a side view with the upper hot plate 7, being separate from the mould 2, as in FIG. 1.

Figure 3:
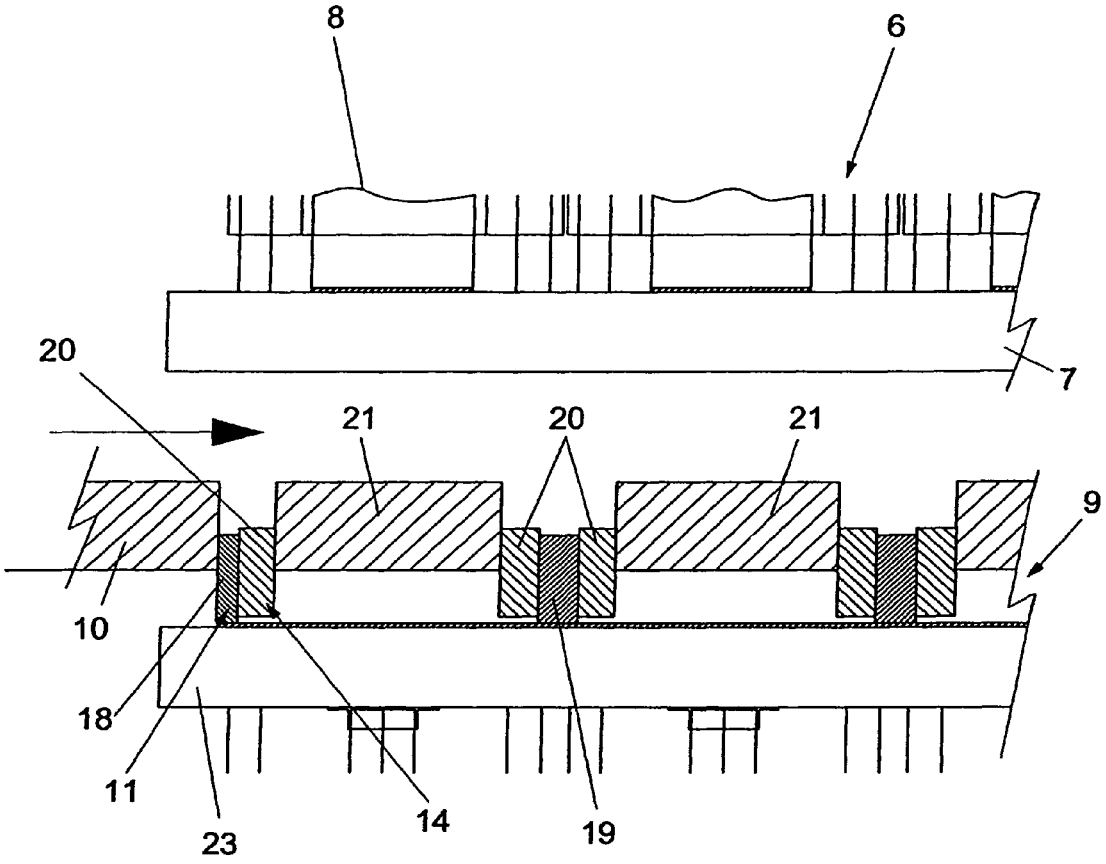
FIG. 3. Is a schematic view in longitudinal elevation of the mould in which several door cores are produced simultaneously in a single operation, including the upper hot plate of the press in the raised position for permitting charging of the mould, along with the lower platform linked to the telescopic rectangular frameworks, also corresponding to the section along the line of cut A-A of FIG. 4.
Figure 4:
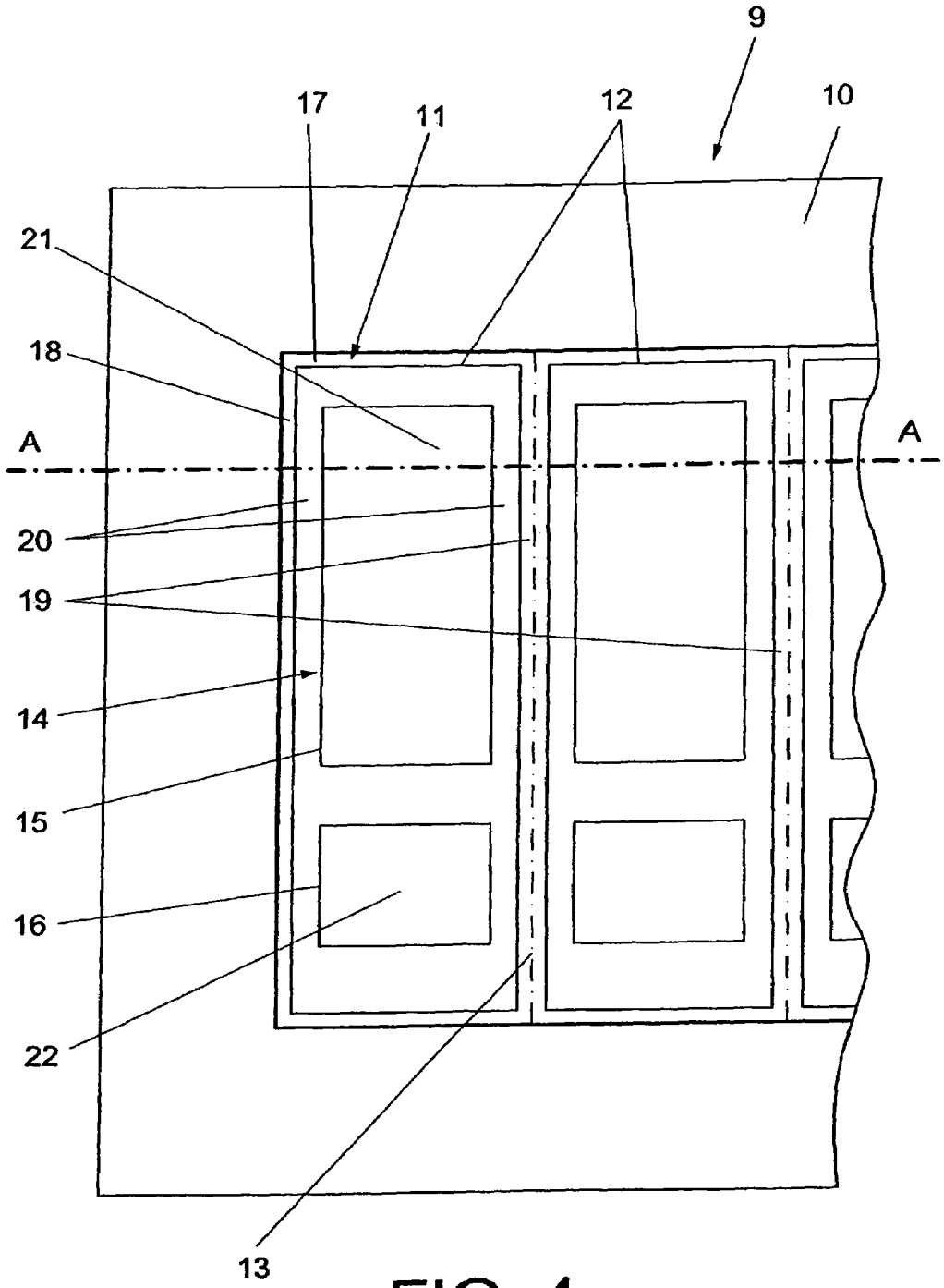
FIG. 4. Is a partial view in plan of the mould for the simultaneous production of several door cores with two voids of different dimensions for fitting boards or for glazing, in accordance with FIG. 3.

The mould 9 is represented schematically in elevation in FIG. 3 and in plan in FIG. 4. The perimeter framework 10 is fixed and determines the walls of the mould 9 (see FIG. 4). Sliding in its internal perimeter is the first rectangular framework 11 which follows its contour exactly and can slide in it in the manner of a plunger. It has the same surface as the doors to form (at least three are seen in FIG. 4 since it is a partial view in plan) and it is a surface with as many apertures 12 as there are door cores to form. The line of union of two adjacent doors is represented with lines 13 of dashes and dots which will later on be cutting lines for the board in order to separate the different door cores formed in a single pressing, at the end of the process.

Sliding in each aperture 12 is the respective second rectangular framework 14 which has the voids 15 and 16 for paneling or glazing, of different dimension in the example of embodiment that is shown.

The first rectangular framework 11 is defined by the spars 17, end cross-members 18 (of which just the left-hand one can be seen in FIG. 4) and central cross-members 19, the latter being double the size since, as we will see immediately below, they have to serve so that the end strips of the two consecutive door cores that they determine remain equally compacted as in the perimeter zones.

All these sections of the movable frameworks 11 can be clearly seen in FIG. 3.

Each one of the second frameworks 14 has some sections in the transverse direction, parallel and sliding in the sections referenced with 18 and 19 of the first rectangular framework 11, referenced in this case with the number 20.

The references 21 and 22 designate the fixed blocks which occupy the position of the voids 15 and 16 for paneling or glazing.

The rectangular framework 11 is integral with the lower platform 23.

Figure 5:
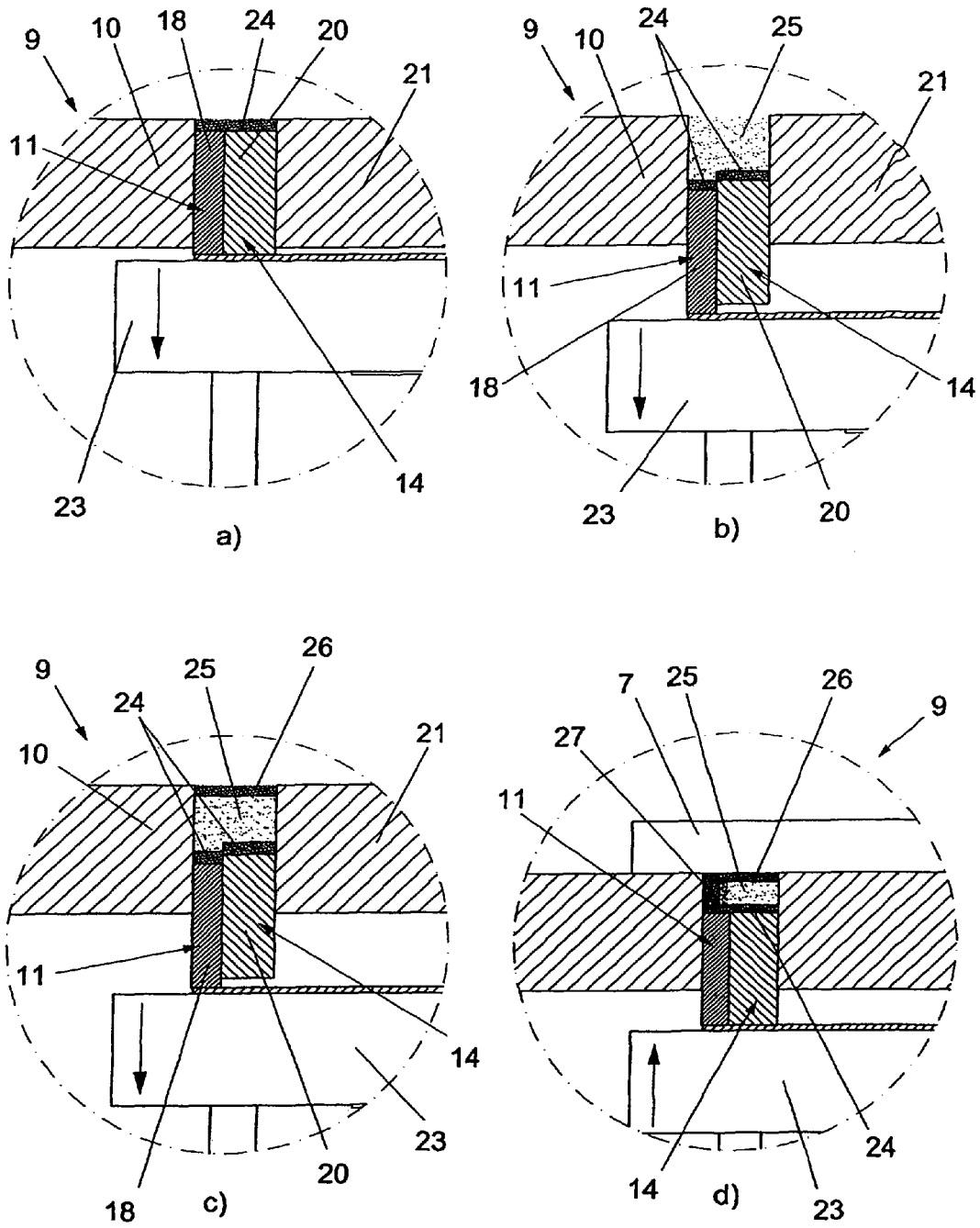
FIG. 5. Is a sequence of movements for filling of the mould with the product to press, coming from the two formers, including in the final position (d) the upper hot plate which closed the mould in order to permit the pressing.

With this arrangement and with special reference to FIG. 5 in which can be seen different sequential phases of the manufacture of this product, the filling of the mould and final pressing is carried out in the following manner:

The product supplied from the first former 1, measured and weighed, passes to the metering device 3 and from there to the mould 9 when the rectangular frameworks 11 and 14 are flush (just the respective sections 18 and 20 can be seen in the different positions or phases of this FIG. 5) and withdrawn with respect to the edge of the perimeter framework 10.

In the enlarged detail of FIG. 1, the structure of the geared metering device can be seen that is very precise since half the product contained in the metering device 1 has to be discharged into the mould. This first layer that is poured into the mould corresponds to the lower layer of the sandwich and is referenced with 24 in position a).

After that, this metering device 3 undergoes a lateral displacement towards the right of FIG. 1, with the metering device 4 remaining continuous and integral with it, in the position of discharging on the mould 9. In this displacement a sweeping or leveling of the mould has simultaneously taken place so that the lower layer 24 can be made homogenous and the surface of the mould is left clean.

Next, the total discharge of this second metering device 4 takes place with the thicker product or the central part of the sandwich, once both rectangular frameworks 11 and 14 have descended to occupy position b) of this FIG. 5 (in these figures just the transverse sections of the frames can be seen, corresponding to the references 18 and 20 respectively). This is achieved by operating the hydraulic cylinders to the preselected degree, which command the displacement of the telescopic rectangular framework 14, located on the lower platform 23. Due to being staggered in this charge position and the rectangular framework corresponding to the section 18 having undergone greater travel than the section 20 of the rectangular framework 14, a greater quantity of product is received in the periphery of the mould. This intermediate layer distributed in this way is referenced with the number 25.

Next the return takes place of the first metering device 3 in order to be situated above the mould 9 again, at the same time as a sweep or leveling of it is carried out and the simultaneous descent takes place of both telescopic frameworks 11 and 14 (sections 18 and 20 respectively), according to a descent travel corresponding to the thickness of the remaining outer layer of the sandwich, with this finer product being discharged until the mould is filled according to the layer referenced with 26 in position c) of this FIG. 5. As can be clearly seen, the central layer 25 is thicker in the left-hand zone than in the right-hand zone as was intended so that, at the end of the compaction, the density of the perimeter can be greater than in the central zone. In the periphery of the voids for paneling or glazing 15 and 16, a greater density is not needed since this is where the moulds for fitting those panels or panes of glass have to be situated.

Once the mould 9 is filled, the metering devices 3 and 4 return to the original position outside of the mould 9 in order to permit the descent of the upper hot plate 7 until making contact with it, as corresponds to position d) of FIG. 5.

Finally, when the lower platform 23 is raised up to the height corresponding to the final thickness of the door core, the two rectangular frameworks 11 and 14 become flush and continue to rise up in this way as far as occupying the position d) of this FIG. 5.

As can be deduced from observing FIG. 5, once the setting time has passed, the upper hot plate 7 rises up and the stripping of the mould can take place as the lower platform 23 continues to rise up. When the pressed board has exited the mould, it is withdrawn in order to commence a new cycle.

In this position d) of FIG. 5, the perimeter part of the middle layer 25 of the sandwich has been referenced with the number 27, which has received a greater quantity of product and is more compacted, by the desired magnitude.

Figure 6:
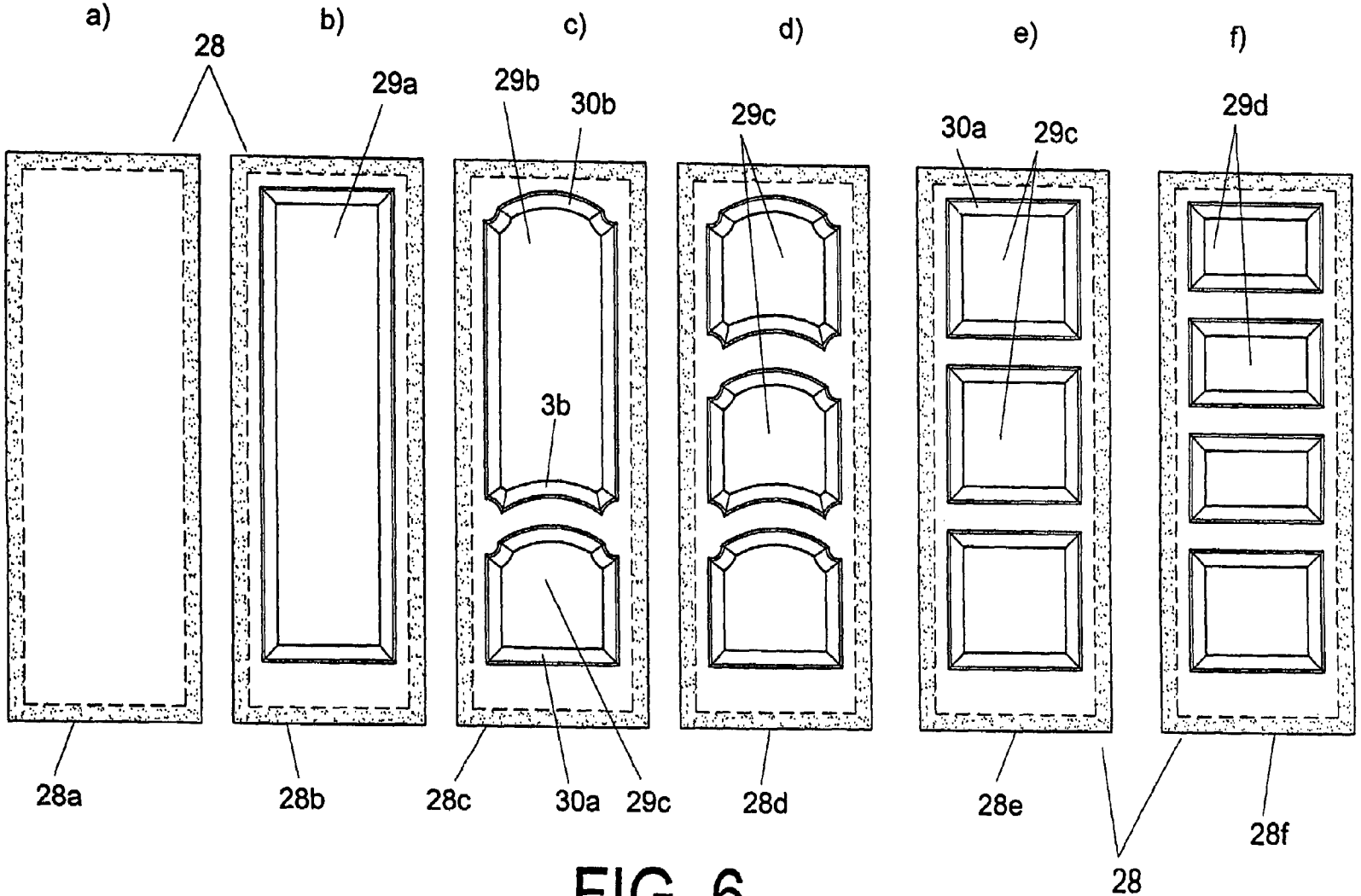
FIG. 6. Is a view in plan of the mould showing by way of example different models of doors that can be manufactured starting from the respective door cores formed in the mould in accordance with the invention, corresponding to the positions a, b, c, d, e and f.

Making reference now to FIGS. 6 to 16 we can see certain improvements in the mould for producing door cores according to another embodiment of the invention. As shown in FIG. 6 it permits the manufacture of door cores that are both solid 28*a* (position a) and with one or more voids for paneling or glazing, simply by acting rapidly on certain elements of its structure, depending on the position, number and/or distribution of those voids. Shown in position b) is a door 28*b* with just a one void 29*a* with a rectangular shape. Shown in position c) is a door 28*c* with two voids 29, 29*c* with straight or arched battens or moldings 30, the straight pieces being identified with the reference 30*a* and the arched ones with 30*b*. In position d), a door 28*d* with three voids 29*c* which combine straight moldings 30*a* with curved ones 30*b*, and in position e) the door 28*e* has three voids 29*c* with straight moldings 30*a* only. Finally, in position f) the door 28*f* has four voids 29*d*, the lower one being of greater height than the rest. In order to facilitate the designation of these elements: doors, voids and battens will be respectively referred to with the generic references 28 (doors), 29 (voids) and 30 (moldings), even though they might be geometrically different.

Figure 7:
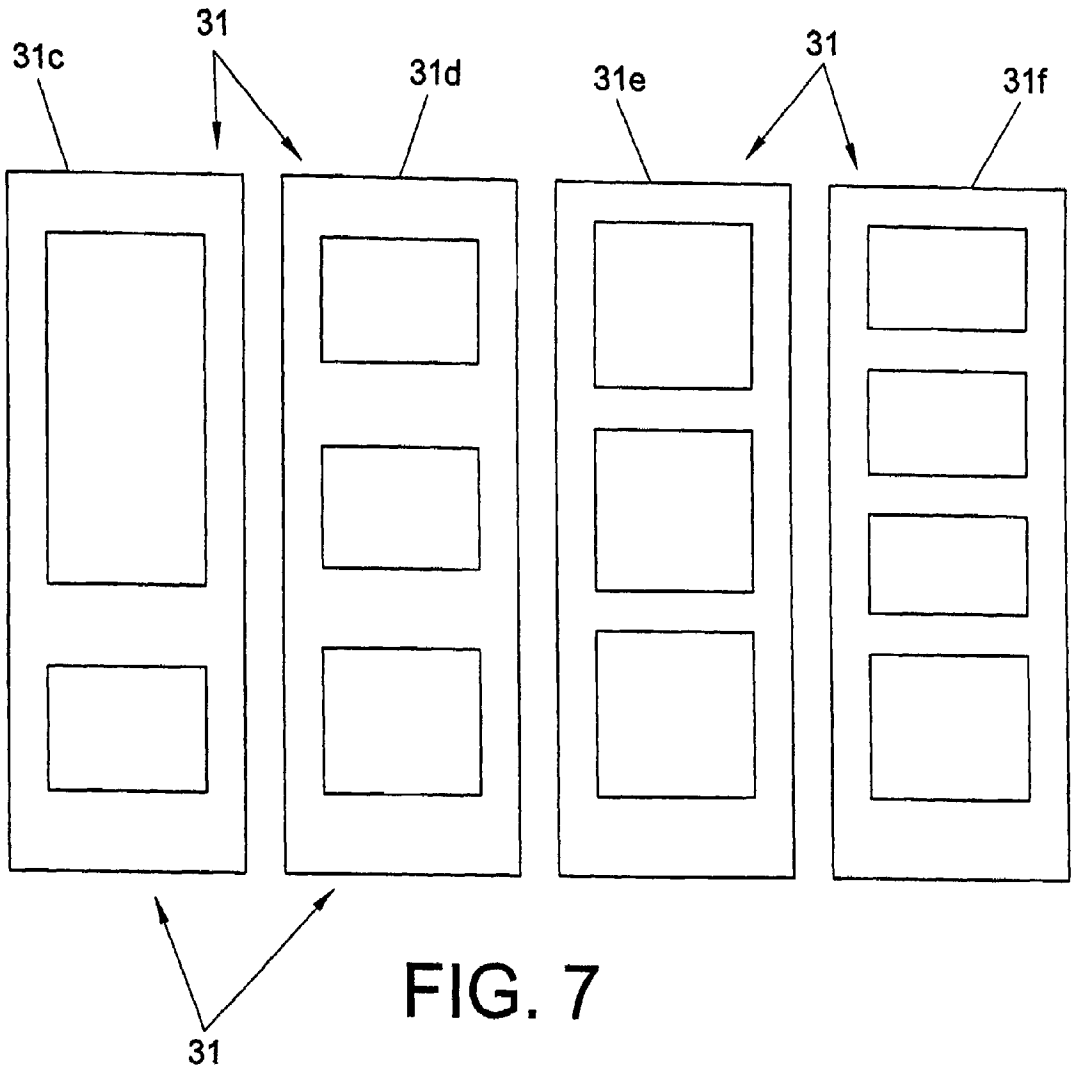
FIG. 7. Is a view in plan of different door cores corresponding to the positions c, d, e and f of FIG. 6.

FIG. 7 shows different door cores corresponding to the same doors as in FIG. 6 (positions c, d, e and f), which merely have to be laminated, edged and be fitted with straight or curved battens 30, being referenced with 31*c*, 31*d*, 31*e* and 31*f*, respectively, an in general we will designate them with 31.

We can see for example that the door core 31*d* and the door core 31*e* have their voids at different measurements in terms of height because the first ones have to be machined in the horizontal borders which have to have curved battens fitted.

The door 28*a* of FIG. 6 would correspond to a door core 31*a* not represented in this FIG. 7 and which we will call solid, in other words, without any voids for paneling or glazing.

Figure 8:
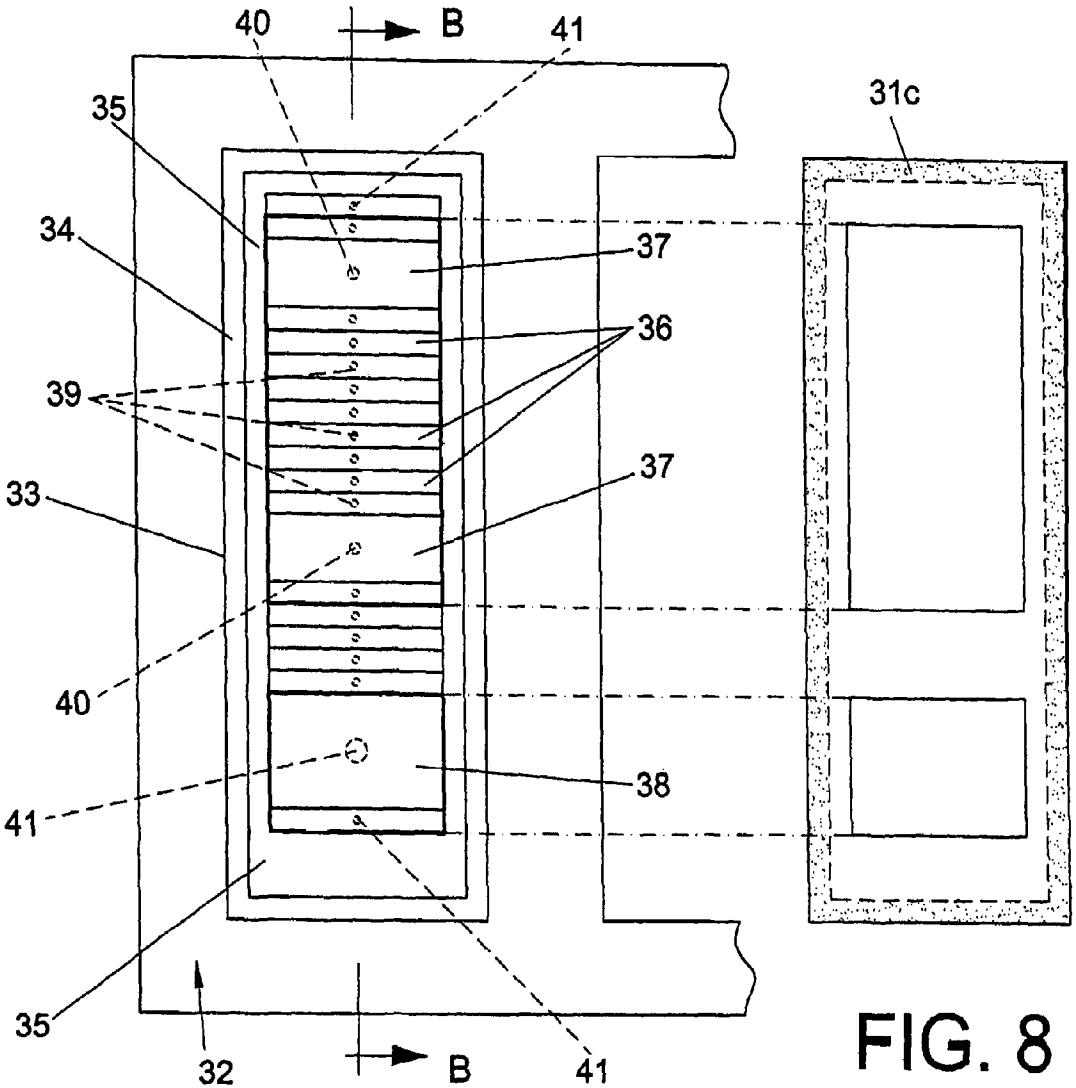
FIG. 8. Is a partial view in plan of a mould for the manufacture of door cores, in accordance with the invention, prepared for producing door cores of the shape shown in correspondence.
Figure 9:
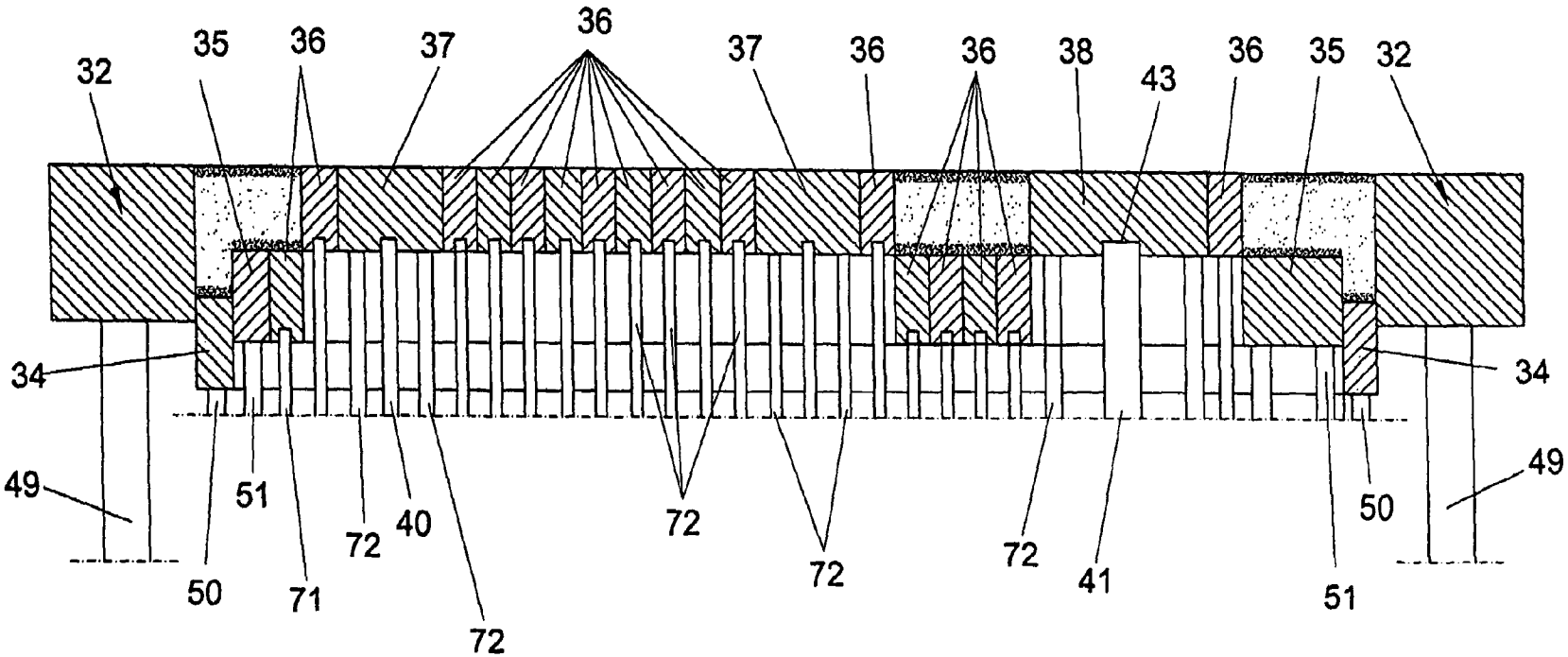
FIG. 9. Is a section along the line of cut B-B of FIG. 8.

FIGS. 8 and 9 show, partially in plan, the mould for producing door cores in accordance with this second form of embodiment of the invention, determined by the robust frame 32 which is fixed and defines the mouth of the mould for simultaneously manufacturing three door cores 31 in this case, having three corresponding apertures 33 which have the contour and dimensions of the "door cores" 31 to manufacture (all those shown and which can be made with this mould have the same standard measurement in their contour).

Fitting into these apertures 33 are the respective first independent rectangular frameworks 34 or outer frameworks 34 of the telescopic unit which are formed together with the inner rectangular frameworks or second rectangular frameworks 35, both having independent and different displacements in certain phases of the charging and pressing of the product, as we will see further below, mainly in relation to FIG. 10.

The inner surface of the second rectangular framework 35 is occupied by traverse pads or blocks provided in a battery arrangement, some of small size (referenced with 36), others of medium size referenced with 37 and another of larger size than the others referenced with 38.

Figure 12:
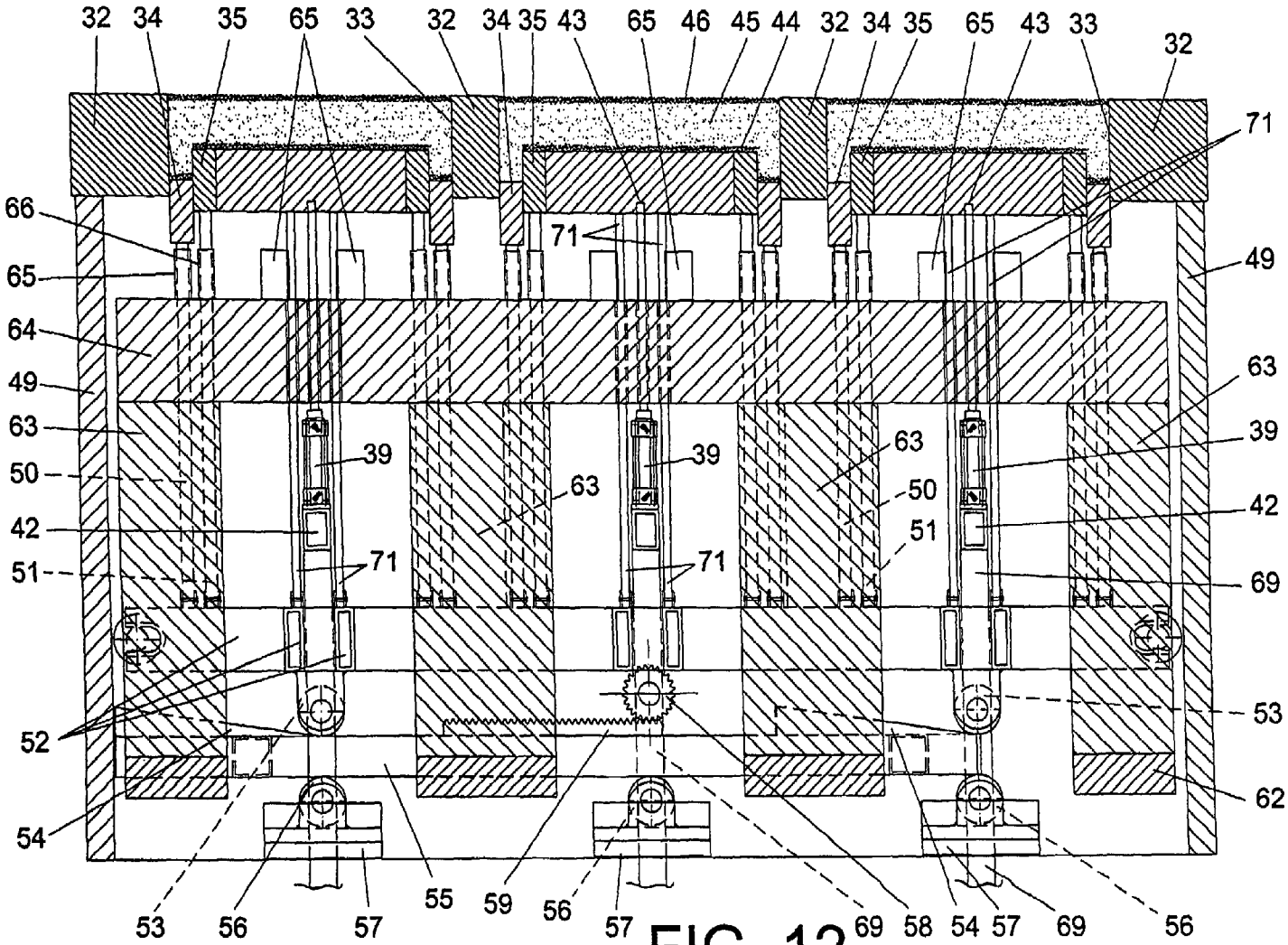
FIG. 12. Is a view on a greater scale of the actual mould of FIG. 11.

These pads 36, 37 and 38 are actuated by respective hydraulic cylinders 39, 40 and 41 of measurements proportional to them, all of which rest on the transverse bars 42 which follow the midlines of the apertures 33. In FIG. 8 the rods of these cylinders can be seen which are connected to the recesses 43 of the base of those respective pads (FIG. 12).

Figure 10:
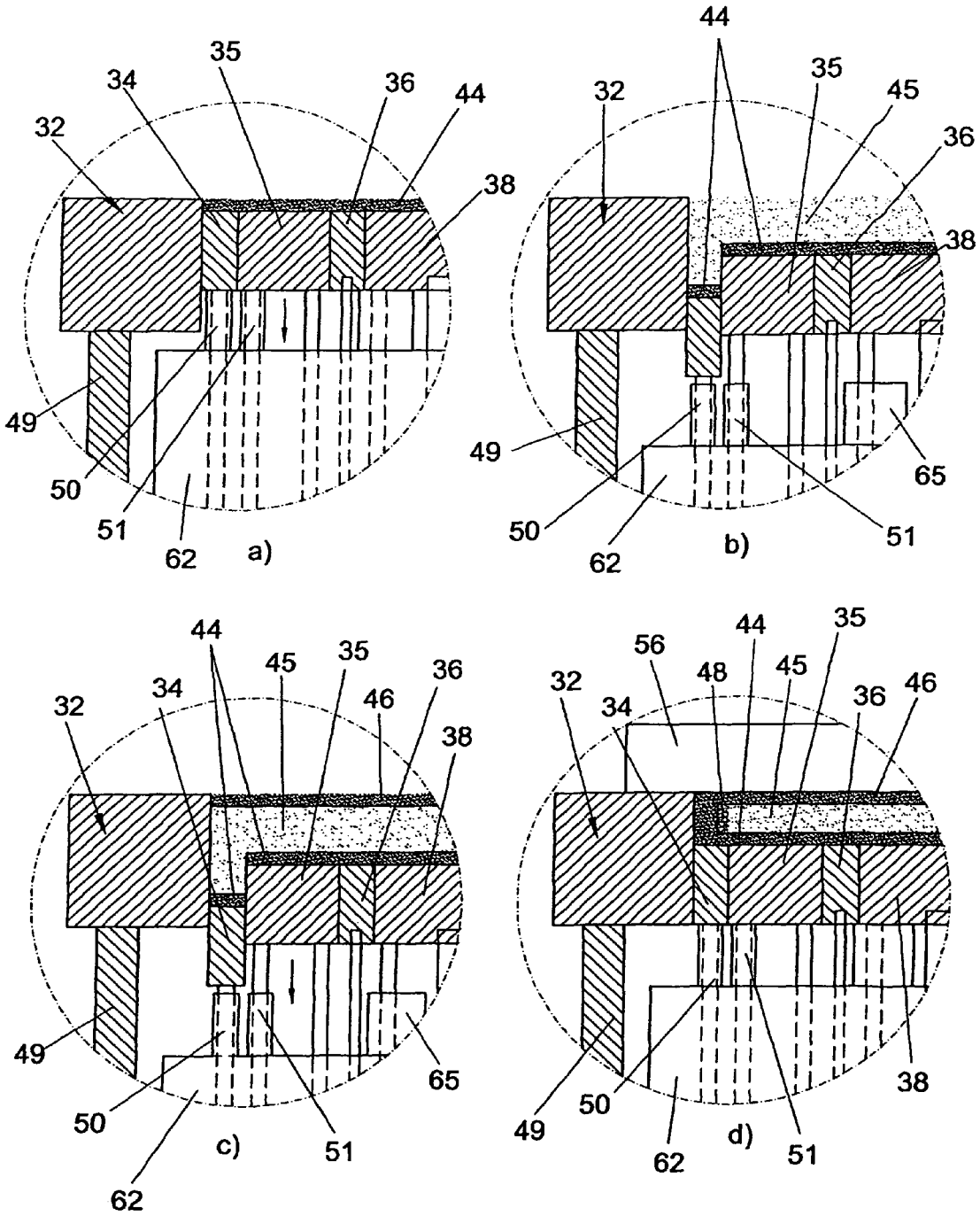
FIG. 10. Is a sequence of movements in four phases a), b), c) and d) for filling the mould and pressing of the product until the final thickness of the door core is obtained.

In FIG. 10 can be seen the different sequential phases of the manufacture of the door cores: filling of the mould and final pressing, which is carried out in the following manner:

The product supplied from the first former, measured and weighed, passes to a metering device and from there to the mould when the rectangular frameworks 34 and 35 are flush with respect to the border of the perimeter frame 32 or filling mouth of the mould.

For the discharge, a geared metering device is used that is very precise since half the product contained in the first metering device has to be discharged intro the mould. This layer that is poured into the mould corresponds to the lower layer of the sandwich and is referenced with 44 in the position a).

Next, a lateral displacement takes place of the first metering device with the second device (attached in the adjacent position) being left in the discharge position above the mould.

In this displacement a sweeping or leveling of the mould has simultaneously been carried out so that the lower layer 44 is homogenous and the surface of the mould is clean. After that, the total discharge of this second metering device takes place with the thicker or central product of the sandwich, once both rectangular frameworks 34 and 35 have descending occupying the position b) of this FIG. 10 (in this figure just the transverse section of the rectangular frameworks can be seen). This is achieved by operating the hydraulic cylinders to the preselected degree, which command the downwards displacement of the telescopic rectangular frameworks, located in the lower part as we will see later on. Due to being staggered in this charge position and the first rectangular framework 34 having undergone greater travel than the second rectangular framework 35, a greater quantity of product is received in the periphery of the mould. This intermediate layer distributed in the manner commented on is referenced with the number 45 in this FIG. 10.

Next the return takes place of the first metering device in order to be situated above the mould again, at the same time as a sweep or leveling of it is carried out and the simultaneous descent takes place of both telescopic frameworks 34 and 35 according to a descent travel in order to receive the remaining outer layer of the sandwich (position c) with the finer product until the mould is filled according to the upper layer referenced with 46 in position c) of this FIG. 10. As can be clearly seen, the intermediate layer 45 is thicker in the periphery as was intended so that at the end of the compaction (position d), the density of the perimeter will be greater than in the central zone. The lateral compaction against the fixed frame 32 means that the edge of the core is of greater density. In the periphery of the voids for paneling or glazing, a greater density is not needed since this is where the moulds for fitting those boards or panes of glass have to be situated.

Prior to the compaction taking place, the metering devices return to their original position outside of the mould in order to permit the descent of the hot plate 47 of the press (best seen in FIG. 11) as far as making contact with it, as shown by position d) of FIG. 10. When the compaction starts, the two rectangular frameworks 34 and 35 that are staggered start to become flush with each other and they continue to ascend in that way until they occupy position d) of this FIG. 10, as far as the height corresponding to the final thickness of the door core. Once the setting time has passed, the upper hot plate 47 is raised and the mould can be stripped since the lower cylinders continue to extend themselves hydraulically. When the pressed board has exited from the mould, it is withdrawn in order to start a new cycle.

In position d) of FIG. 10, referenced with the number 48 is the perimeter zone of the intermediate layer 45 of the sandwich, which has received a greater amount of product and remains more compact.

Figure 11:
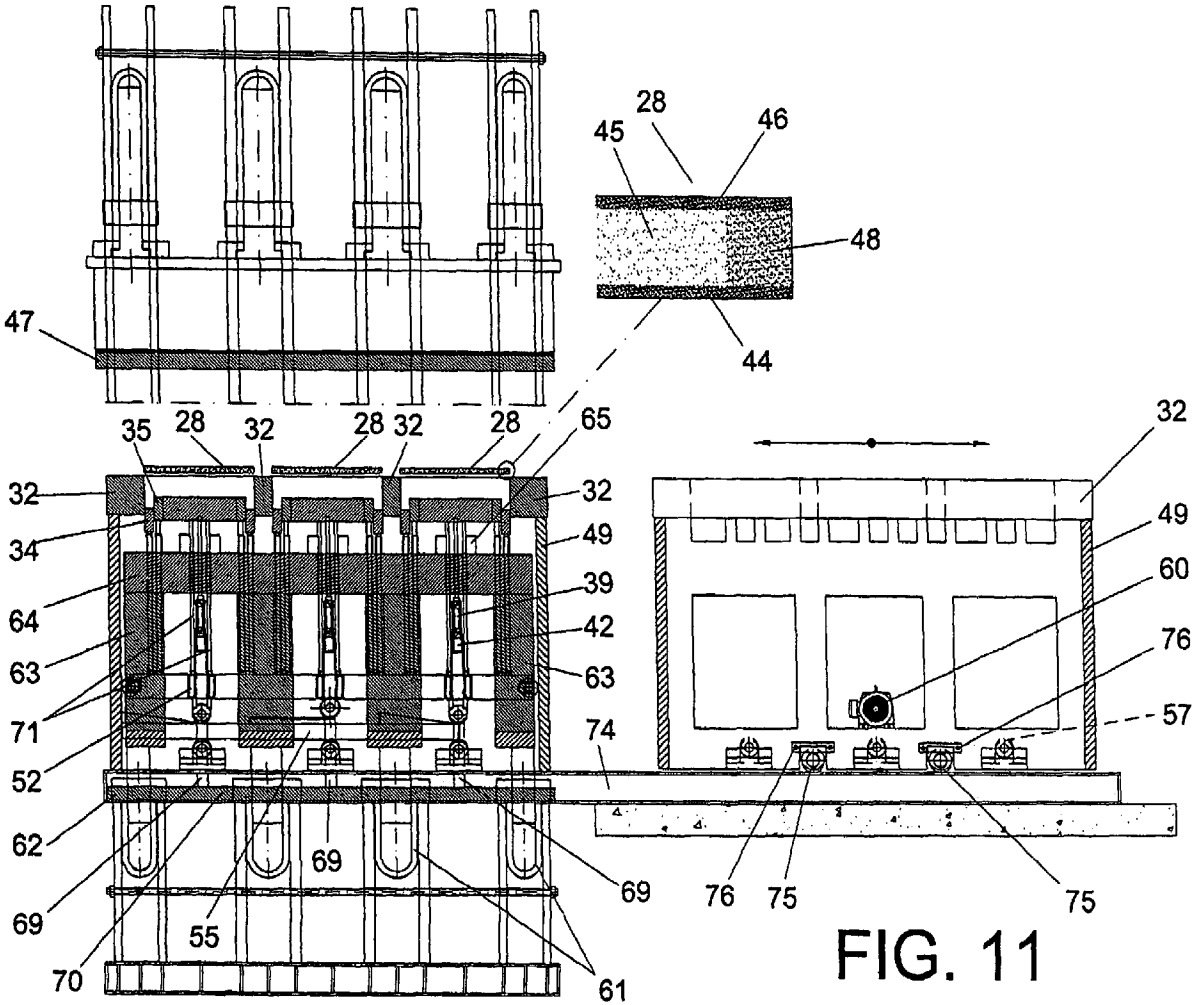
FIG. 11. Is a view in longitudinal elevation of a mould in accordance with the invention, in which, by way of example, three solid door cores are formed simultaneously, being located beneath the gantry press and on its right is shown the extraction position of the mould out of the press for its repair or maintenance.
Figure 15:
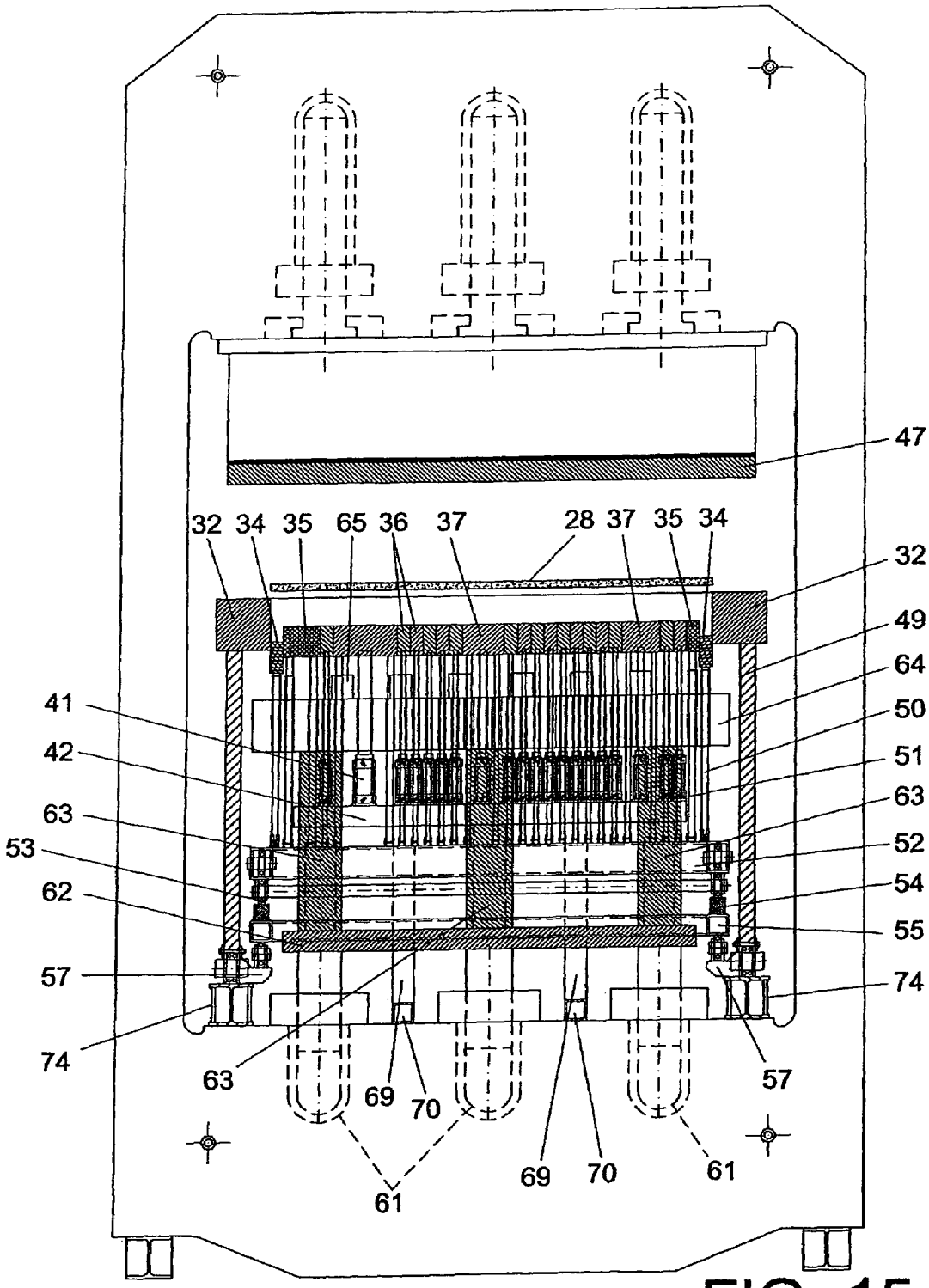
FIG. 15. Is a view in transverse elevation of the same mould of FIG. 11, located beneath the gantry press.
Figure 16:
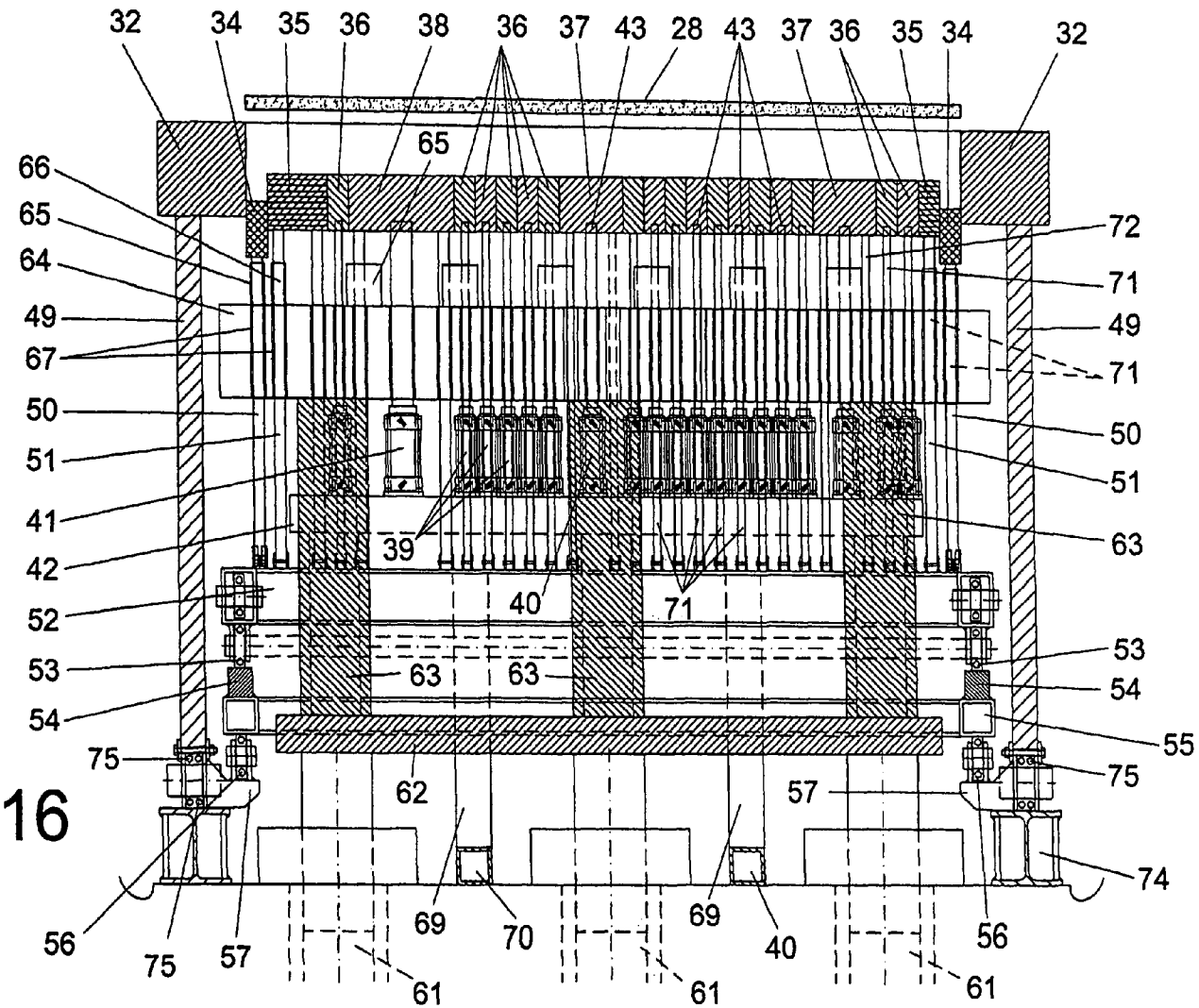
FIG. 16. Is a view on a greater scale of the actual mould of FIG. 15.

In FIGS. 11 and 15, and more enlarged in FIGS. 12 and 16, it can be seen how the pads 36, 37 and 38 are flush with the second framework 35 and are displaced jointly as we will see. In this case, a solid door core 28 is formed since the product that falls from the metering devices would fill the entire surface of the mould (in the three apertures 33) of FIG. 12.

The support structure of the frameworks and the displacement of them presents the following configuration:

The fixed frame 32 carrying the apertures 33 or charging mouths for the product are supported on the perimeter walls 49. The first rectangular framework 34 of each aperture rests on some vertical rods 50 and the second frameworks are supported on some vertical rods 51 of greater length in order to maintain the stagger that permits a greater charge. The height of this stagger can be advantageously varied by inserting a greater or lesser number of shims in the base of the vertical rods. All the vertical rods in turn rest on the framework 52 of wheels 53 which are able to advance on the inclined surface of the ramps 54 attached at the top to the displaceable framework 55 which can do this due to being supported on wheels 56. These wheels 56 are fitted on supports 57 fixed to the longitudinal walls 49 of the support for the fixed frame 32 (see FIG. 16).

In FIG. 12 we can see referenced with 58 the pinion that engages with the rack 59 integral with the displaceable framework 55 carrying the ramps 54. When the drive motor 60 is turned (see the right-hand part of FIG. 6) the wheels 53 of the moveable framework 52 are displaced by the ramps 54 and the frame 52 rises up. In this way, the difference in height manages to be pre-adjusted of the rectangular frameworks 34 and 35 and of the moveable pads 36 or those not occupying the position of the voids for paneling or glazing, which determines the means of adjusting the final thickness of the door core 28 to be produced with the different standard measurements.

Once the position of the ramps 54 has been fixed, they are then driven by the hydraulic cylinders 61 of the press: descending in order to charge the product and ascending for the compaction. The cylinders 61 act on the lower metal strips 62 via the columns 63, thereby pushing the upper platform 64 which is the carrier of the thrusting pads 65 and 66 which act directly on the first and second frameworks. Voids are therefore formed below in order to make it possible for correct cleaning to be carried out.

This upper platform 64 is provided with holes 67 and 68 for the passage of all the rods 50 and 51 in which the first or outer rectangular framework 34 and the second or inner rectangular framework 35 are respectively supported. The vertical rods 50 are only located in the corner zones since they just have to support the actual weight of the framework and the product poured onto it consisting of the conglomerate of wood particles and glue. The vertical support rods 51 for each second rectangular framework 35 are also located in the corner zones for the same reason.

The small hydraulic cylinders 39, 40 and 41 which raise the pads (36, 37, 38) for the formation of voids also pass through openings provided in correspondence with the upper platform 64.

The transverse metal strips 42 in which all the cylinders 39, 40 and 41 are supported rest on other columns 69 which start from the horizontal tubular bars 70 supported on the ground.

Figure 13:
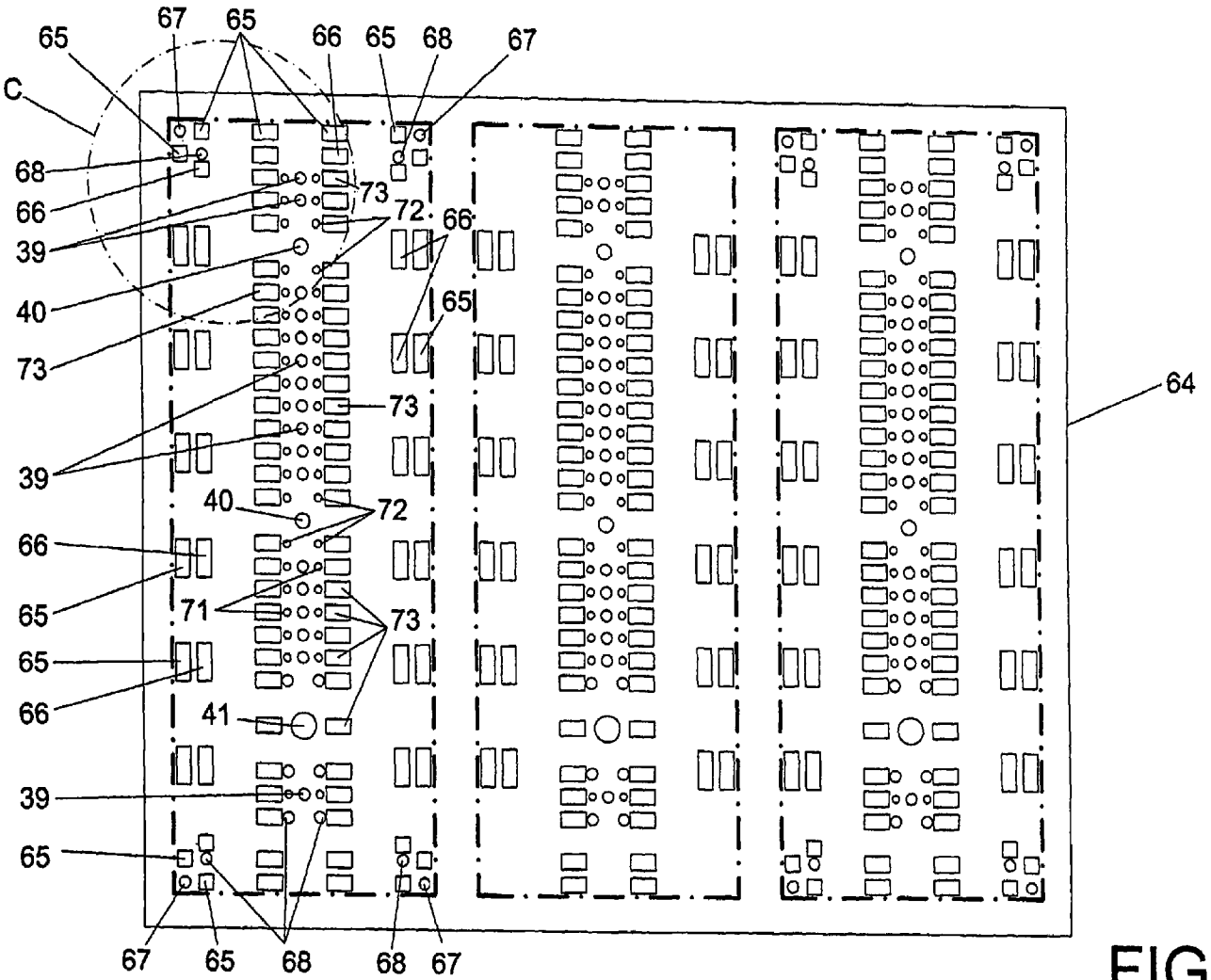
FIG. 13. Is a view in plan of the upper thrust platform and the distribution of the thrusting pads for the first and second rectangular frameworks, along with the pads or blocks permitting the voids to be formed for paneling or glazing.
Figure 14:
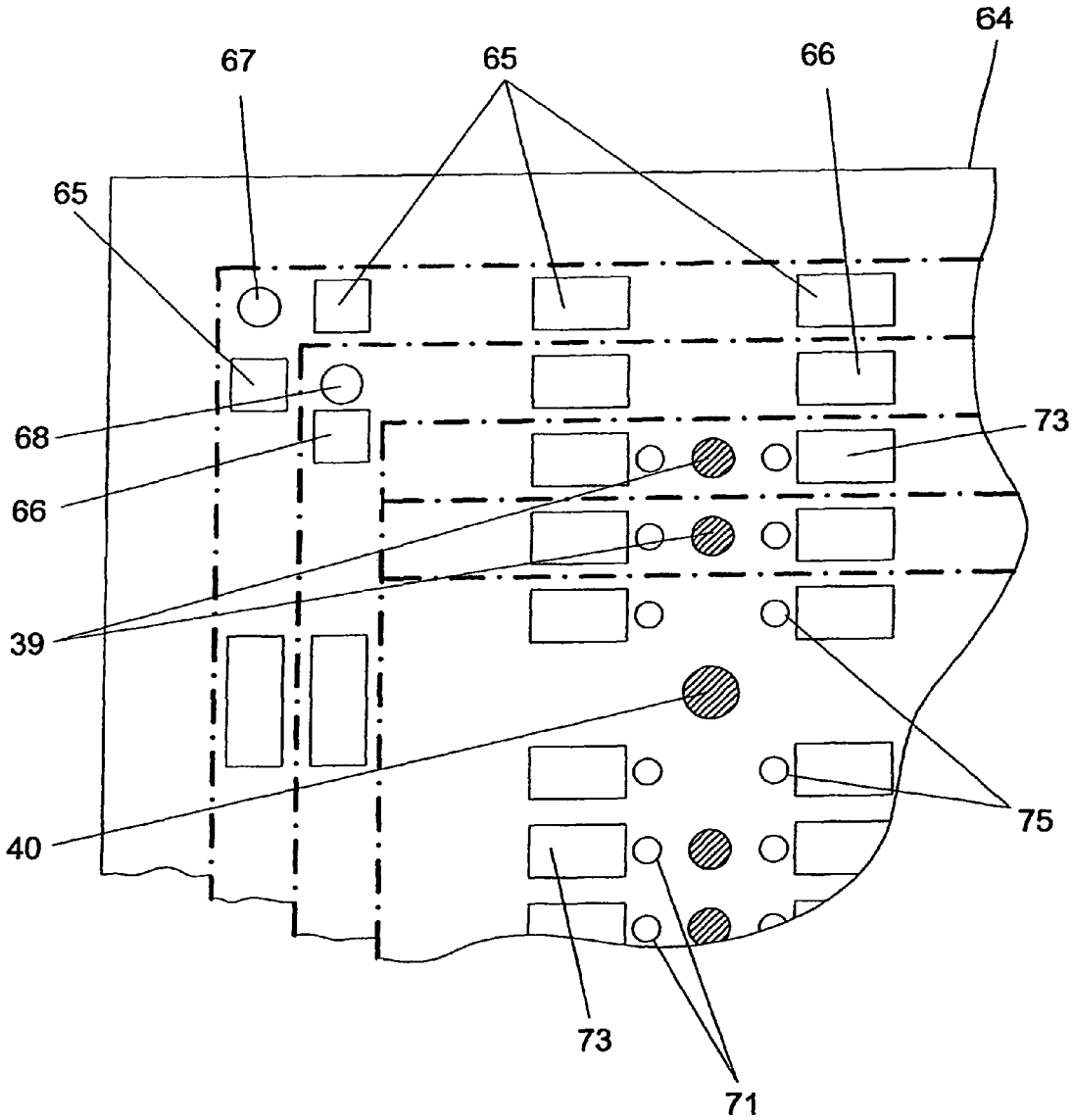
FIG. 14. Is an enlarged view of the detail "C" of FIG. 13.

Just as the first and second rectangular frameworks 34 and 35 are supported on rods 50 and 51, so all the pads 36, 37 and 38 able to form the voids for paneling or glazing (in FIG. 15 there are no voids because solid doors are being formed) do so on pairs of rods 71 or double pairs 72 (depending on the size) which also pass through openings in the upper thrust platform 64 and which rest below on the same framework 52 of wheels 53 as did the rods 50 and 51 all supporting the actual weight of the pads and of the charge which lies on them as we have said earlier, since the compressive forces are only produced by the thrusting pads 65 (for the first rectangular frameworks 34), the thrusting pads 66 (for the second rectangular frameworks 35) and by means of thrusting pads 73, which can be single or double likewise depending on the size; their distribution can be seen in FIGS. 13 and 14 for the pads 36, 37 and 38 forming the voids for paneling or glazing.

The reference 74 designates the rails on which the mould unit is supported by means of the wheels 75 fitted to supports 76 fastened to the longitudinal walls 49 of the support for the fixed frame 32. When it is necessary to carry out a maintenance or repair operation, the wheels are fitted by slightly raising the entire unit with the lower elevator cylinders 61, causing the unit to come away from the rails 74. When the mould returns to its place in the press these wheels 75 are removed.

The first and second frameworks 34 and 35, along with the pads 36, 37 and 38 forming the voids for paneling or glazing have a heating system like the upper hot plate 47 of the press, since the lower hot plate is materialized in them.

Making reference now to FIGS. 17 to 30, we can see that door cores can be produced of standard dimension and also other door cores with special measures: with greater dimensions in length and width and other kinds of oversized doors of larger width than the previous ones.

Figure 17:
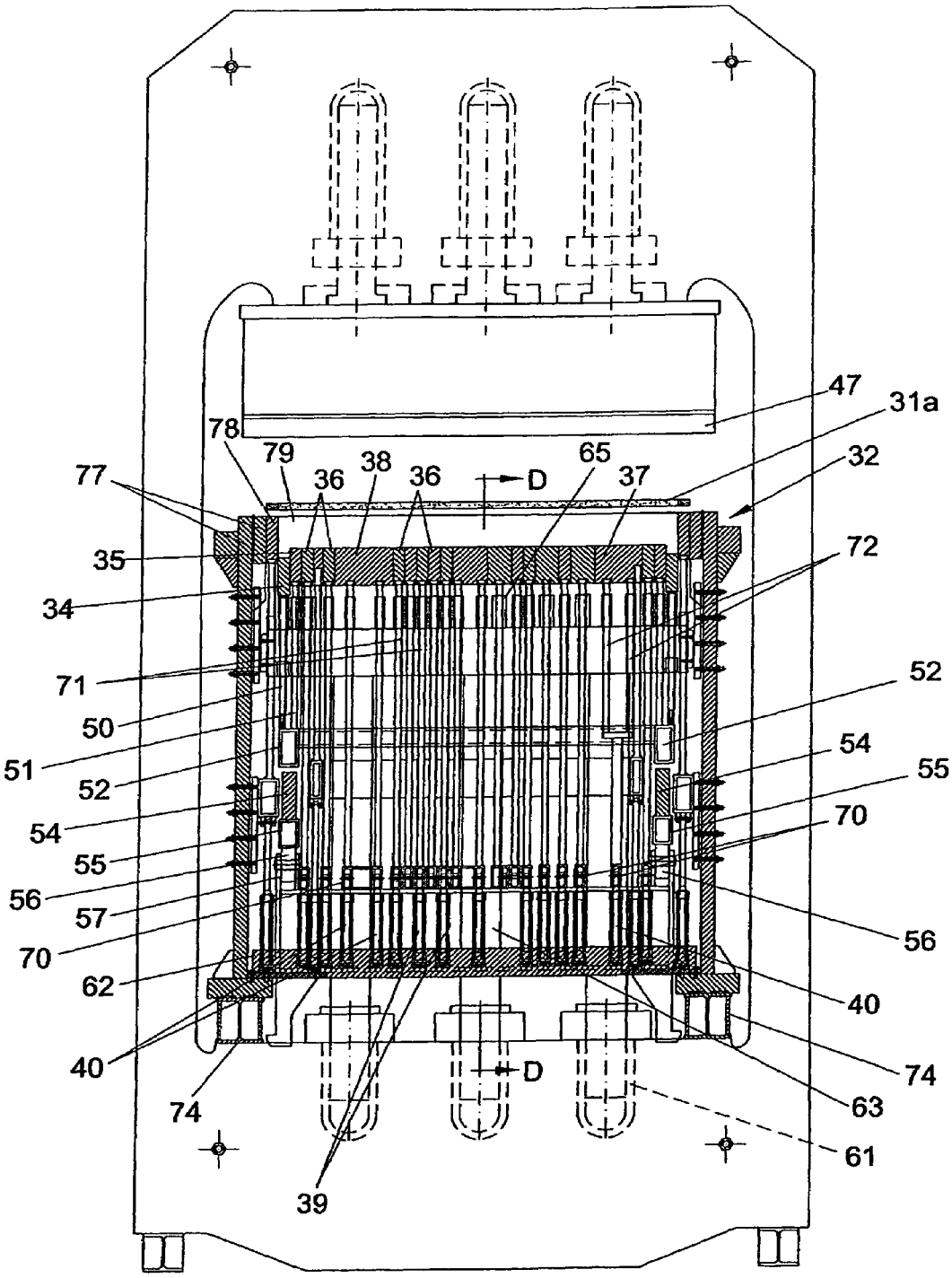
FIG. 17. Is a sectioned view in transverse elevation of a gantry press with a mould for the production of door cores which incorporates some improvements forming the object of this invention, prepared for obtaining in this case solid door cores of greater dimensions in height and width than the standard door cores.
Figure 18:
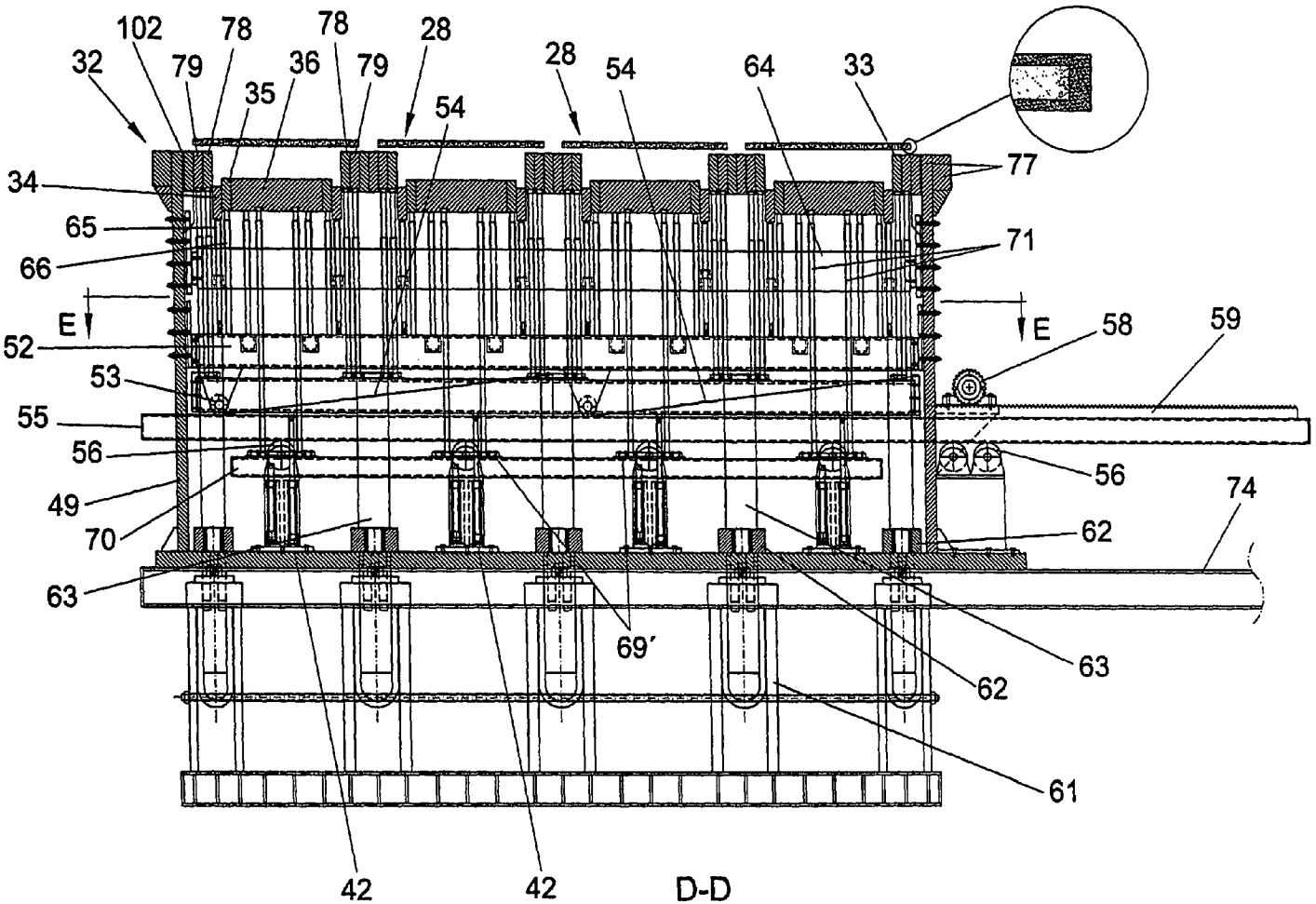
FIG. 18. Is a sectioned view in longitudinal elevation of the same mould of FIG. 17, corresponding to section D-D of that FIG. 17 and for the specific case of simultaneous manufacture of four door cores.

These pads 36, 37 and 38 are actuated by respective hydraulic cylinders 39, 40 and 41 which are supported on fixed transverse bars which follow the midline of the apertures 33 and which, in the case of these FIGS. 17 to 30, rest on lower plates 42 (FIG. 18).

The first rectangular framework 34 of each aperture 33 rests on the vertical rods 50 and the second frameworks 35 are supported by vertical rods 51 of greater length in order to maintain the staggering that permits greater charge. Instead of varying the height of this stagger by inserting a greater or lesser number of shims in the base of the vertical rods, as was considered in the previous form of embodiment (FIGS. 6 to 16) now, as we will see later on, the difference in height is achieved solely by controlling the extension or withdrawal of the hydraulic cylinders, which is done by computer and in a way that is wholly precise.

Figure 19:
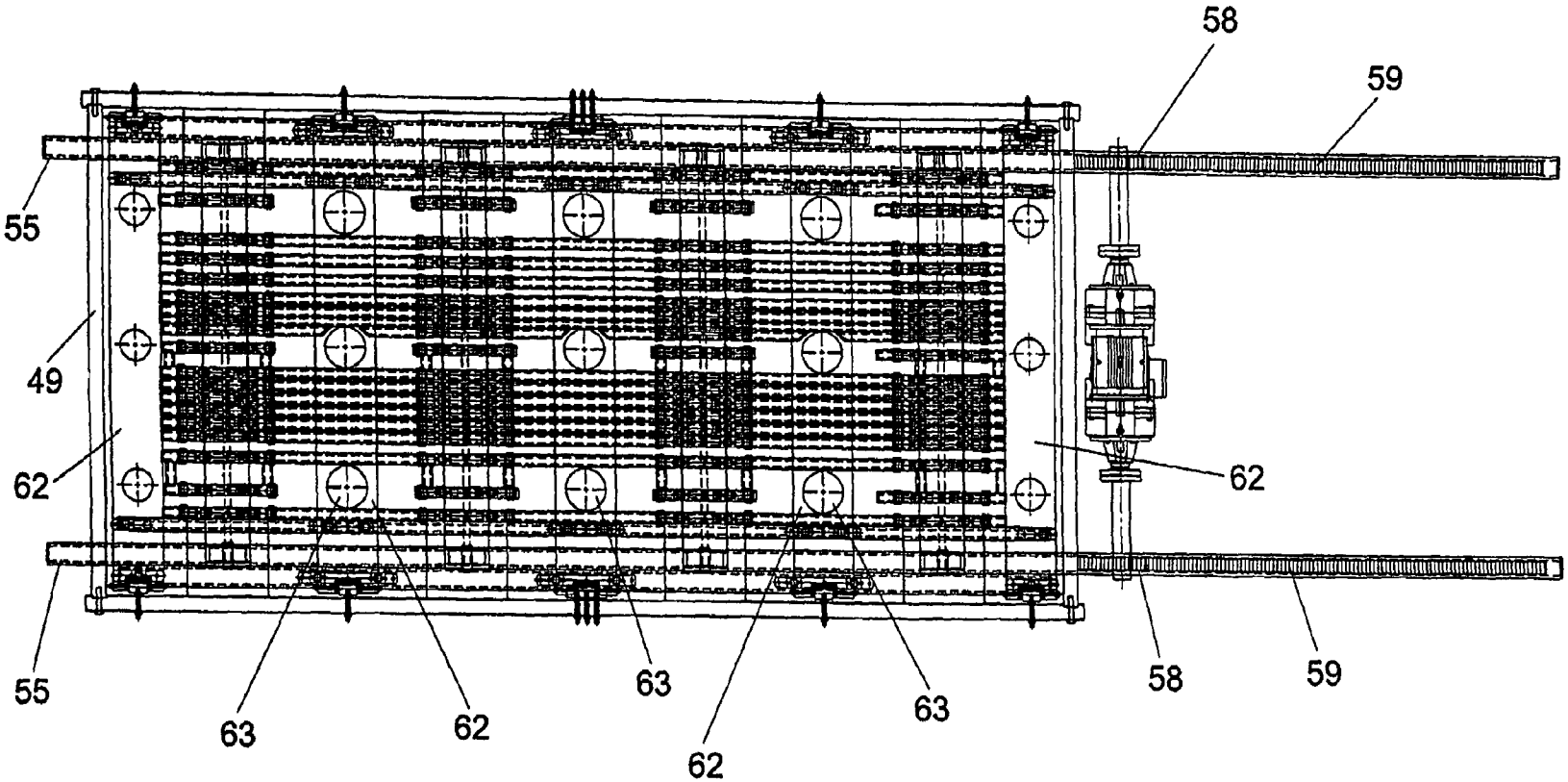
FIG. 19. Is sectioned a view in plan of that shown in FIG. 18 and which corresponds to the section along the line of cut E-E of that FIG. 18.

Also to be seen in FIG. 18 is the pinion 58 which engages with the external rack 59 attached to the displaceable framework 55. In FIG. 19 it can be seen that two racks 59 have been provided, one on each side for greater stability of functioning, in which respective pinions 58 engage inserted in the outlet shaft of the drive motor 60. When this motor turns, the wheels 53 of the moveable frame 52 are displaced by the ramps 54 and the framework 52 rises up.

Resting on the lower transverse metal strips 42 are the cylinders 39, 40 and 41 distributed in pairs and which in this case are all equal, since when the block to raise is of larger dimensions it is raised up with two pairs as can be seen in FIG. 17. Referenced with 39 are the cylinders corresponding to the smaller pads or transverse portions, with 40 are the intermediate size pads and with reference 41 the cylinders used for supporting the large pads. Another solution is to use a pair of cylinders 40 and for the thrusting rod to be straightened as we will see forthwith.

The cylinders 39, 40 and 41 act directly on metal strips or tubular bars 70 that are common to the four units working at the same time. Fixed to these metal strips 70 are some securing platelets 69' for the pairs of rods 71 or double pairs 72 (depending on the size) which also pass through openings in the upper thrust platform 64 and which, in the case of FIG. 17, rest below on the same framework 52 of wheels 53 as did the rods 50 and 51.

So, starting from this structure, the present invention considers certain improvements in what we have called fixed frame 32 or mould walls, making it possible for standard doors to be obtained (those achieved with the component elements that have been explained so far in the section on the preferred form of embodiment) and also other doors of greater dimensions in length and width, as well as those that are oversized in width with respect to the more dimensioned ones and which are used as passage doors in hospitals as we have said earlier.

To achieve this, provision has been made so that the said fixed frame 32 (its section is schematically represented in FIGS. 9 and 10 by a square) is formed by or includes a fixed perimetric part 77 and another interior moveable part 78 also perimetric as we have said at the beginning of this descriptive specification.

Figure 20:
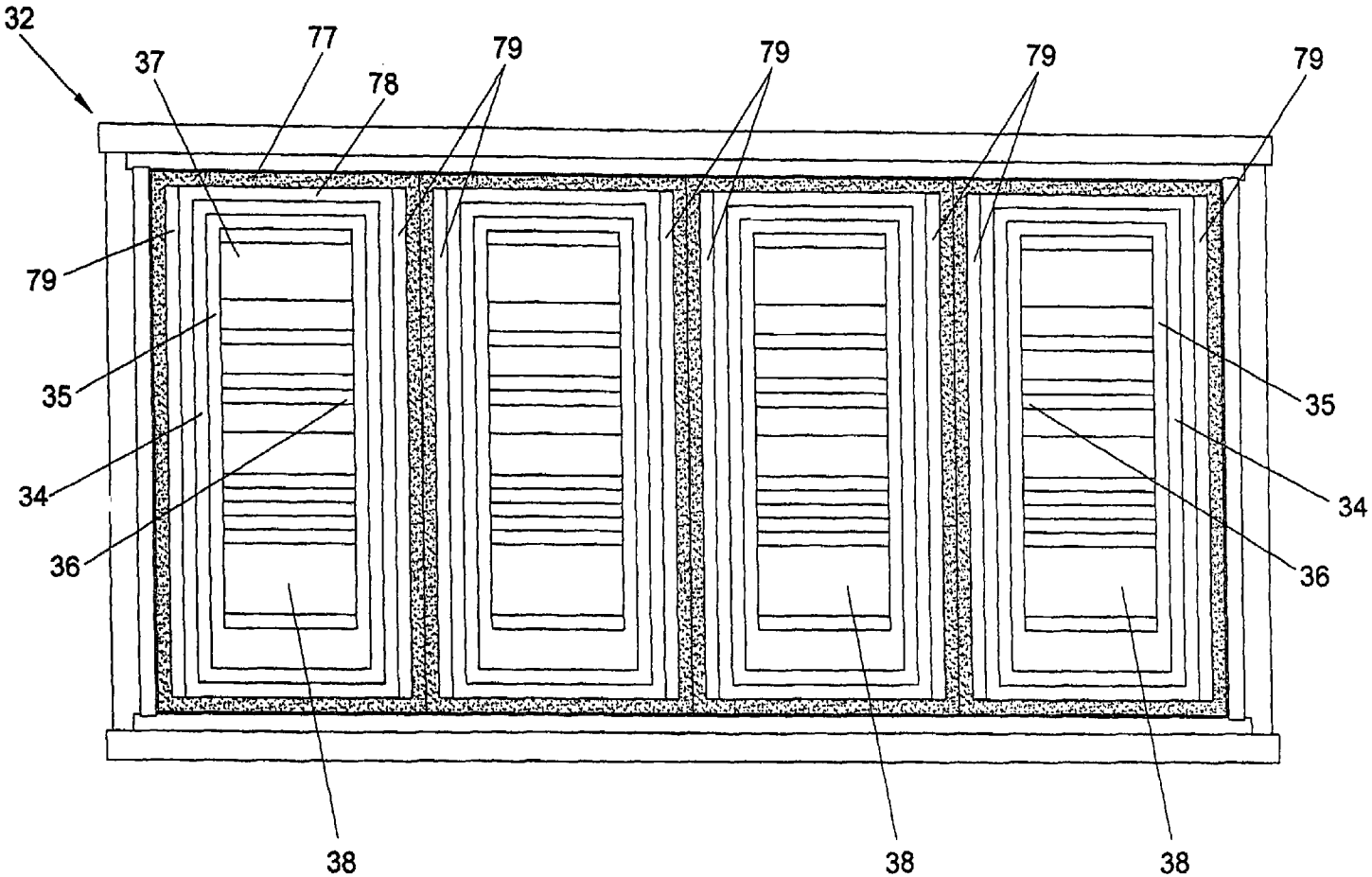
FIG. 20. Is a view in plan of the same mould as in FIG. 18.
Figure 21:
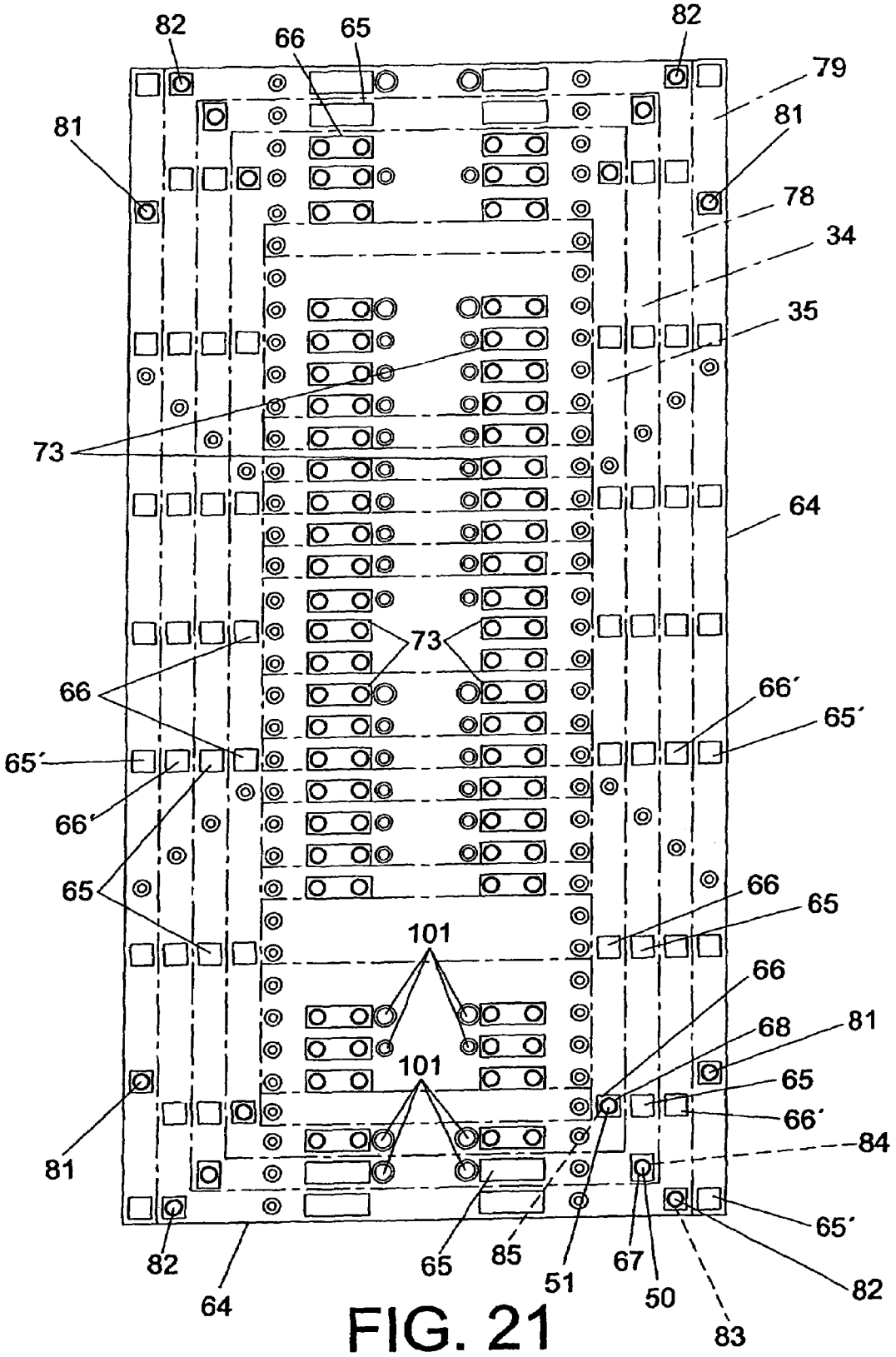
FIG. 21. Is a view in plan of the entire moveable part of a mould unit, in other words, all the elements interior to the contour of the outer fixed perimetric part of each independent unit.
Figure 22:
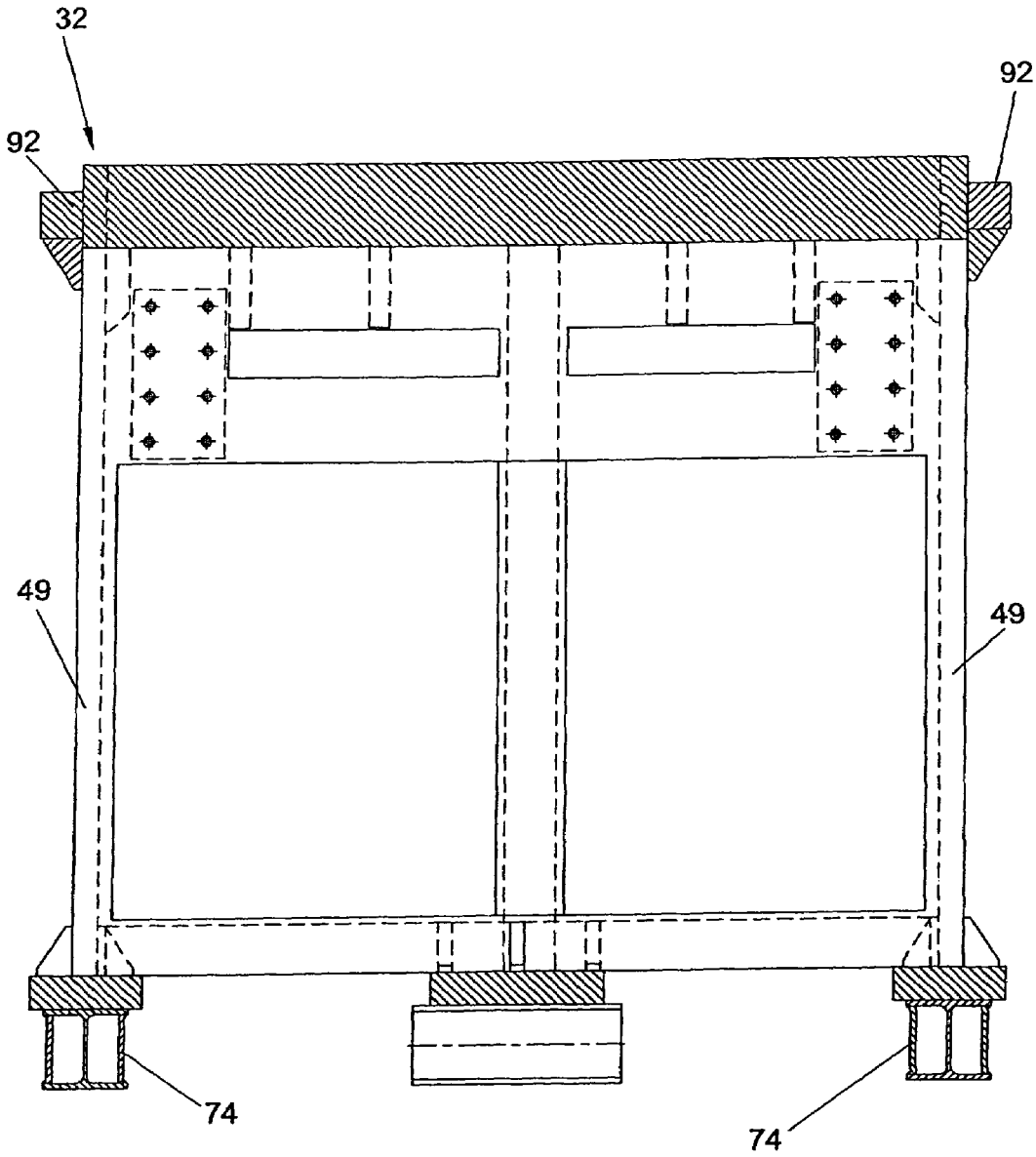
FIG. 22. Is a sectioned view in transverse elevation of the mould for four units, of the fixed part thereof.
Figure 23:
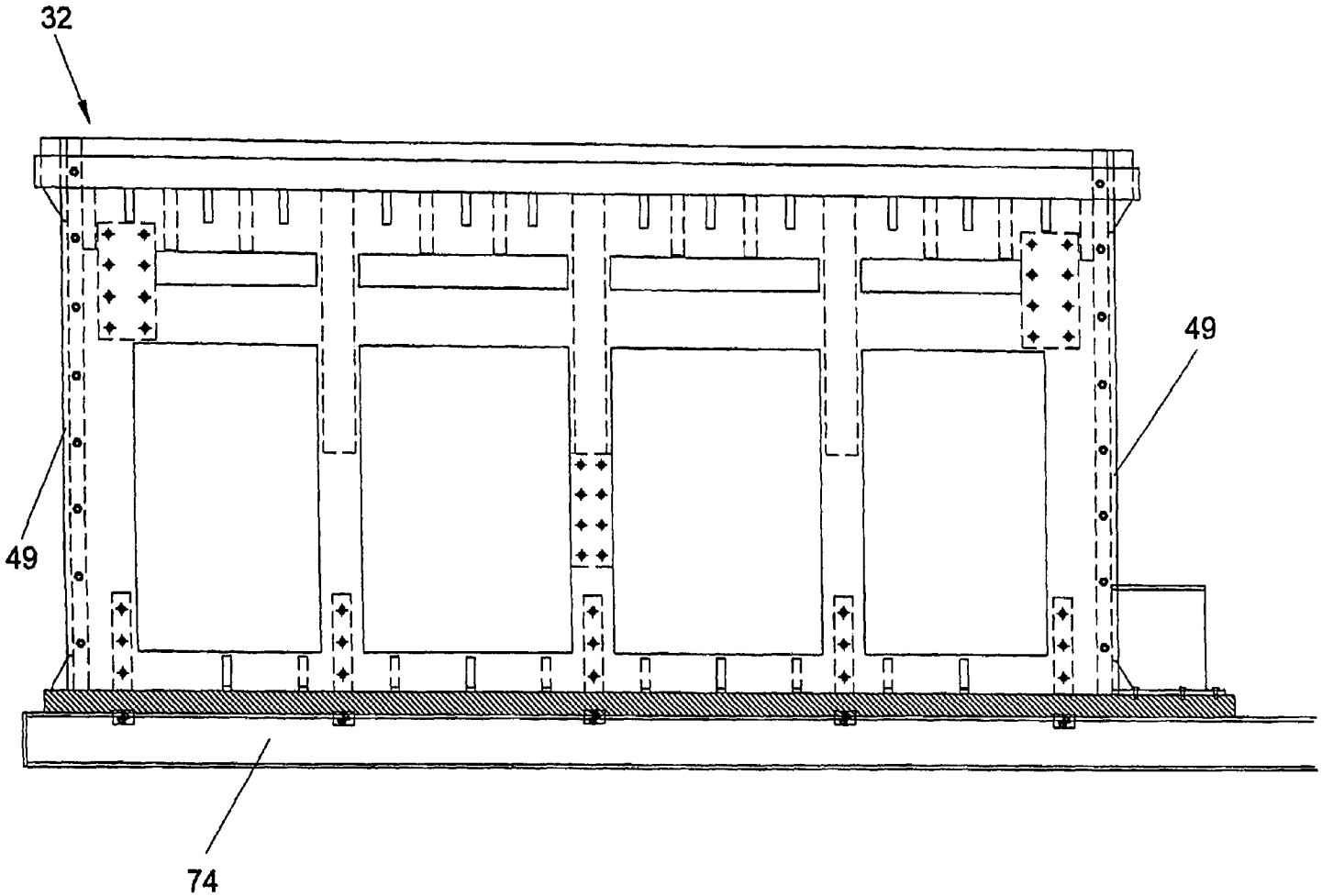
FIG. 23. Is a sectioned view in longitudinal elevation of the same mould of FIG. 22.
Figure 24:
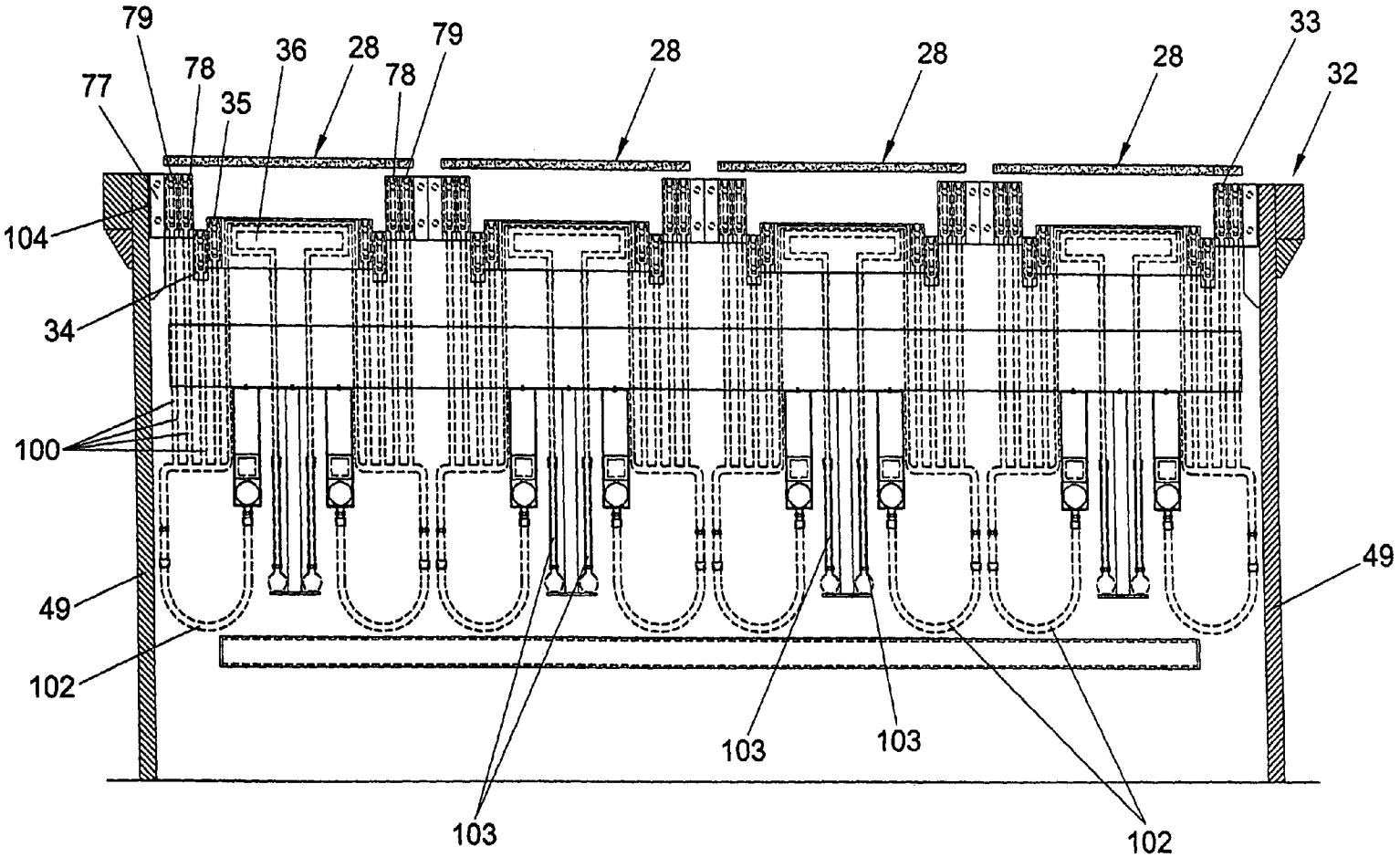
FIG. 24. Is a sectioned view in longitudinal elevation of the same mould for observing the heating and cooling system.

These elements 77 and 78 are seen in plan view in FIG. 20 and in elevation in FIGS. 17 and 18.

Reference 79 designates the metal strips that back onto the longitudinal walls of each independent unit and which can also descend in the special cases of manufacturing oversized doors, as we have already said and as we will see below.

In FIG. 18 the profile of the two metal strips 79 can be seen (one on each side of the unit of the mould) and in FIG. 17 the bottom can be seen. Both are connected to the first vertical rods 80 actuated by the pairs of first hydraulic cylinders 81 (see FIG. 25).

Moreover, the moveable perimetric inner part 78 is connected to some second vertical rods 82 which are raised or lowered by means of the second hydraulic cylinders 83.

The present invention also provides that the first and second frameworks (referenced with 34 and 35 respectively) can be actuated on using high precision hydraulic cylinders 84 and 85 like those used for the metal strips 79 and moveable perimetric part 78 and which are also controlled by computer for being positioned at the desired correct heights. In this way there is no need for the moveable framework 52 with wheels 53 actuated by the ramps 54 of the framework 55, since the simultaneous positioning is achieved by numerical control which commands the precise extension or withdrawal of the cylinders at the appropriate moment, thereby notably simplifying the structure.

Moreover, the hydraulic cylinders 39, 40 and 41 for raising the pads or transverse portions 36, 37 and 38 that are going to form the voids for paneling or glazing, if there are any, are sustained by the pairs of rods 71 or double pairs 72 supported on the cross-member 86 of the T-shapes of the supports 87 to which the elevator hydraulic cylinders 39 are secured (all of them being equal and supported in the same plane as are the cylinders 81 and 83 for governing the metal strips 79 and moveable perimeter part 78), and also the raising and lowering rods 50, 51 for the first and second frameworks 34 and 35.

In the manufacture of oversized door cores, the thrust of the lower cylinders of the press is transmitted to the inner perimetric part 78 and/or to the metal strips 79 via the upper platform 64 on which other thrusting pads are provided referenced with 65' and 66' which are of less height than the thrusting pads 65 and 66 which press on the first and second frameworks, since the latter are of lower height than the former (metal strips 79 and inner perimetric part 78).

Figure 26:
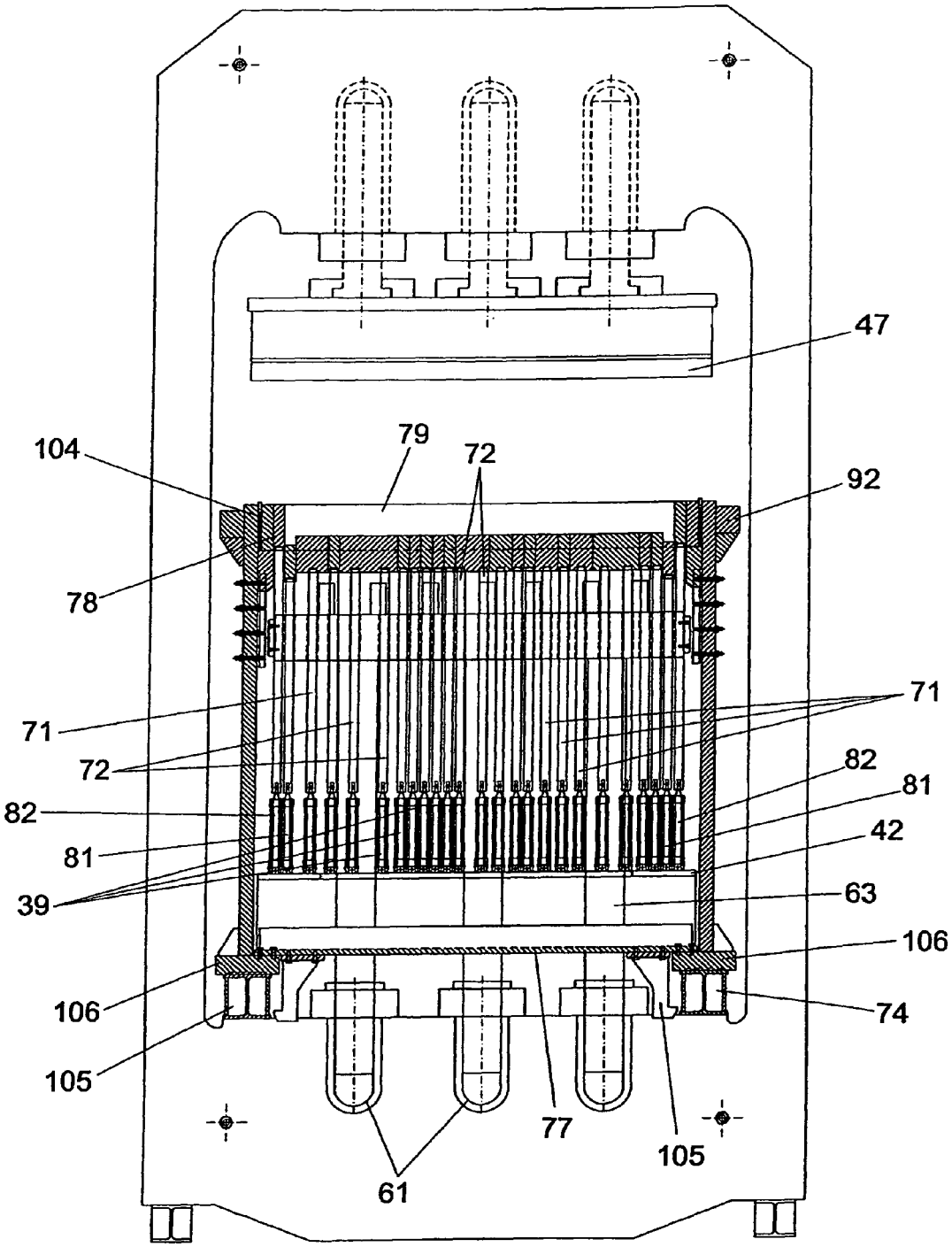
FIG. 26. Is a view in sectioned transverse elevation, similar to that of FIG. 5 but also eliminating the moving frameworks with ramps as mentioned in the previous figure.

Moreover, for the filling of the moulds, metering devices are used which present the structure of FIGS. 27 to 30, defined by a large central hopper 88 and another two side hoppers 89 which are charged with the material of the central layer of the sandwich and with the outsides thereof, respectively, the entire assembly being mounted in the sliding framework or casings 90 with wheels 91 which circulate on tracks 92 in the longitudinal upper part of all the units of the mould (FIG. 26).

The product contained in the hoppers 88 and 89 is discharged in the mould by means of rotating rollers 93 with blades, there existing three of them in the central hopper 88 and one in the side hoppers. The central hopper 88 has the two conveyor shelves 94 which lead the material to press on the blade rollers 93. The material is distributed and is also prevented from forming clumps by means of two flight conveyors 95 (see FIG. 30) which move in a direction transverse to the advance of the conveyor belts 94. The reference 96 designates some deflector sheets for channeling or guiding the product to the exit of the hoppers 88 and 89.

Figure 27:
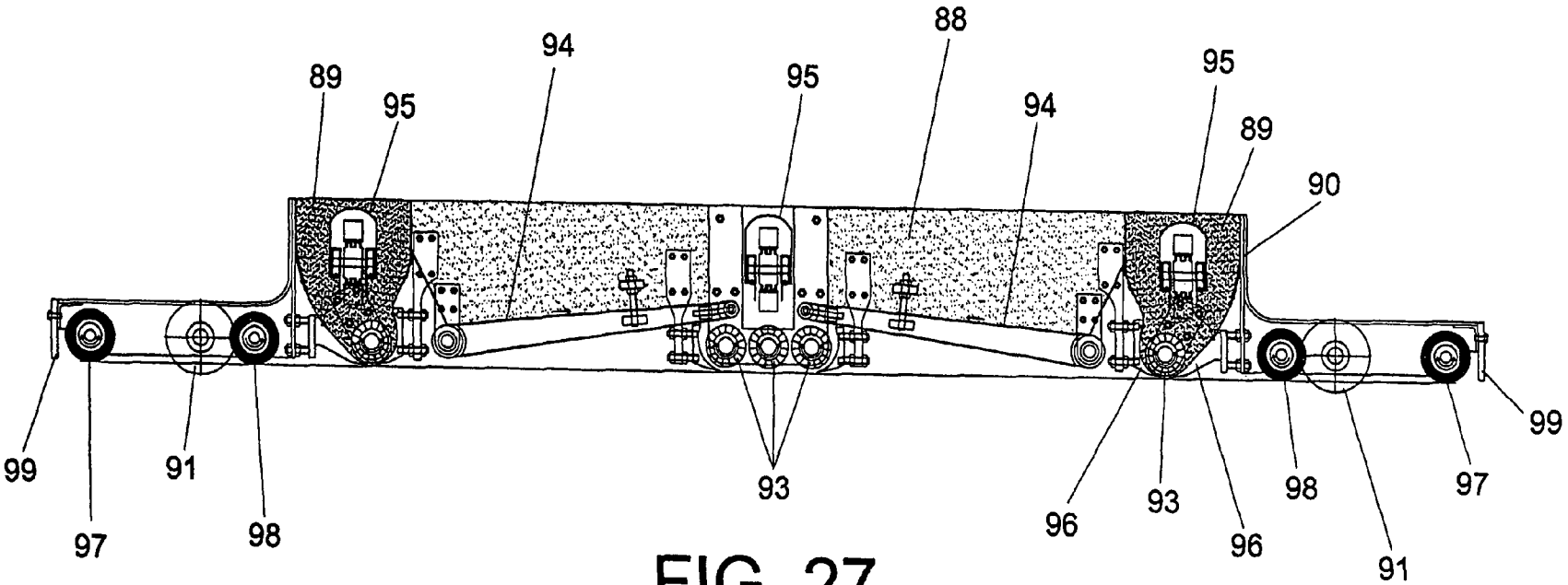
FIG. 27. Is a view in sectioned longitudinal elevation of the carrier framework of the metering devices for filling of the mould, which slides along the upper part thereof, as is observed in FIG. 25.
Figure 28:
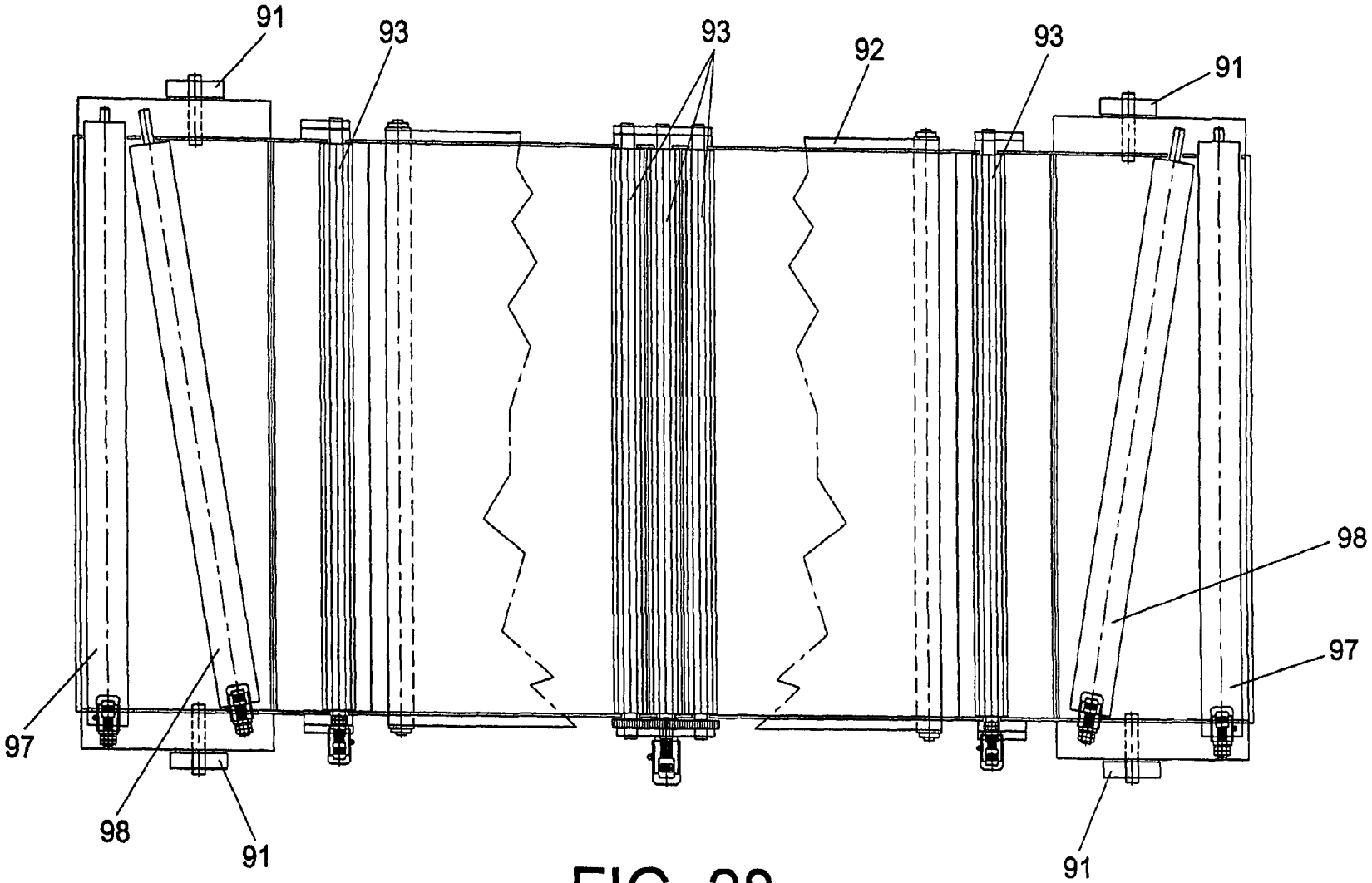
FIG. 28. Is a view in lower plan of that shown in FIG. 17.
Figure 29:
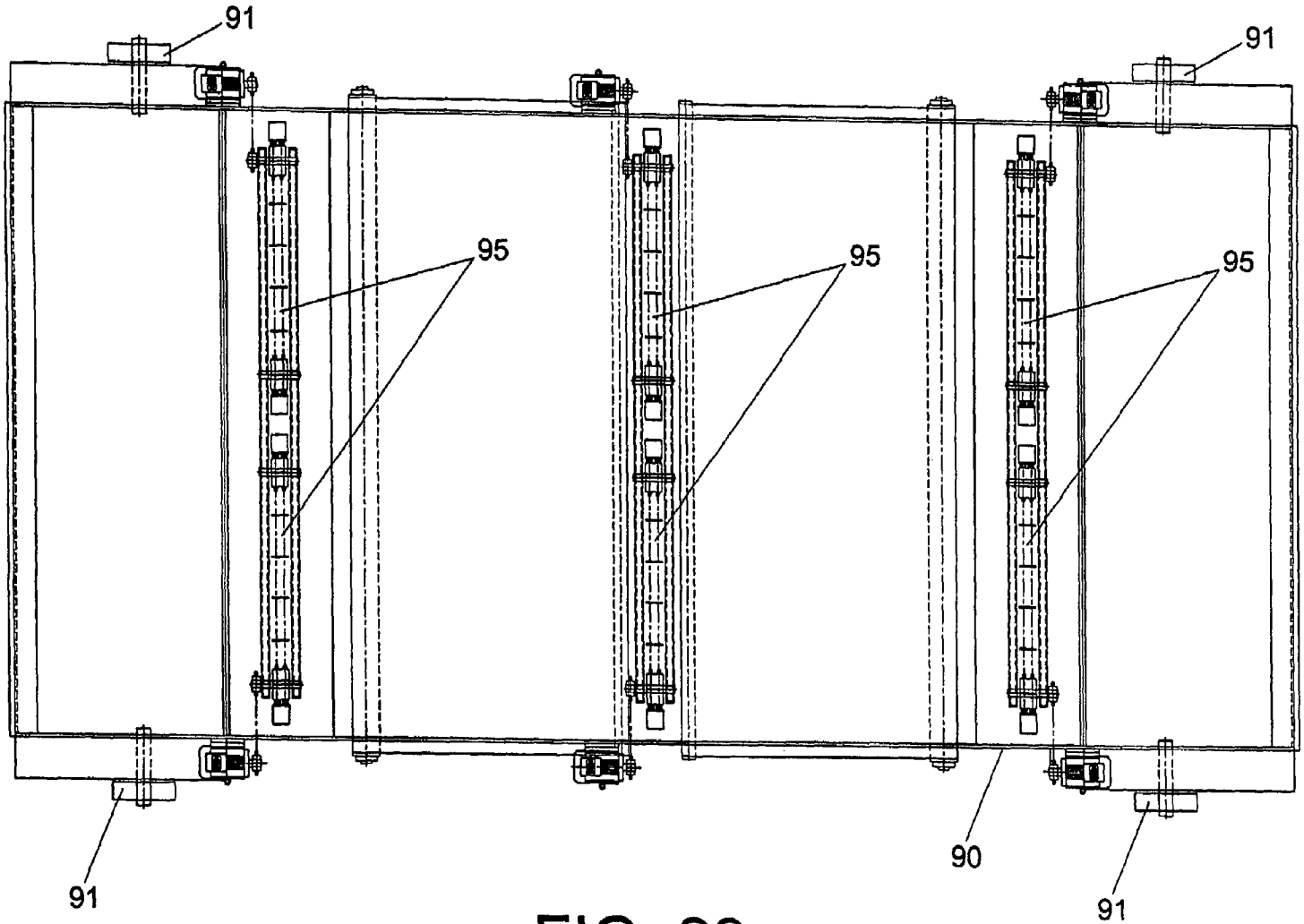
FIG. 29. Is a view in plan of that shown in FIG. 27.
Figure 30:
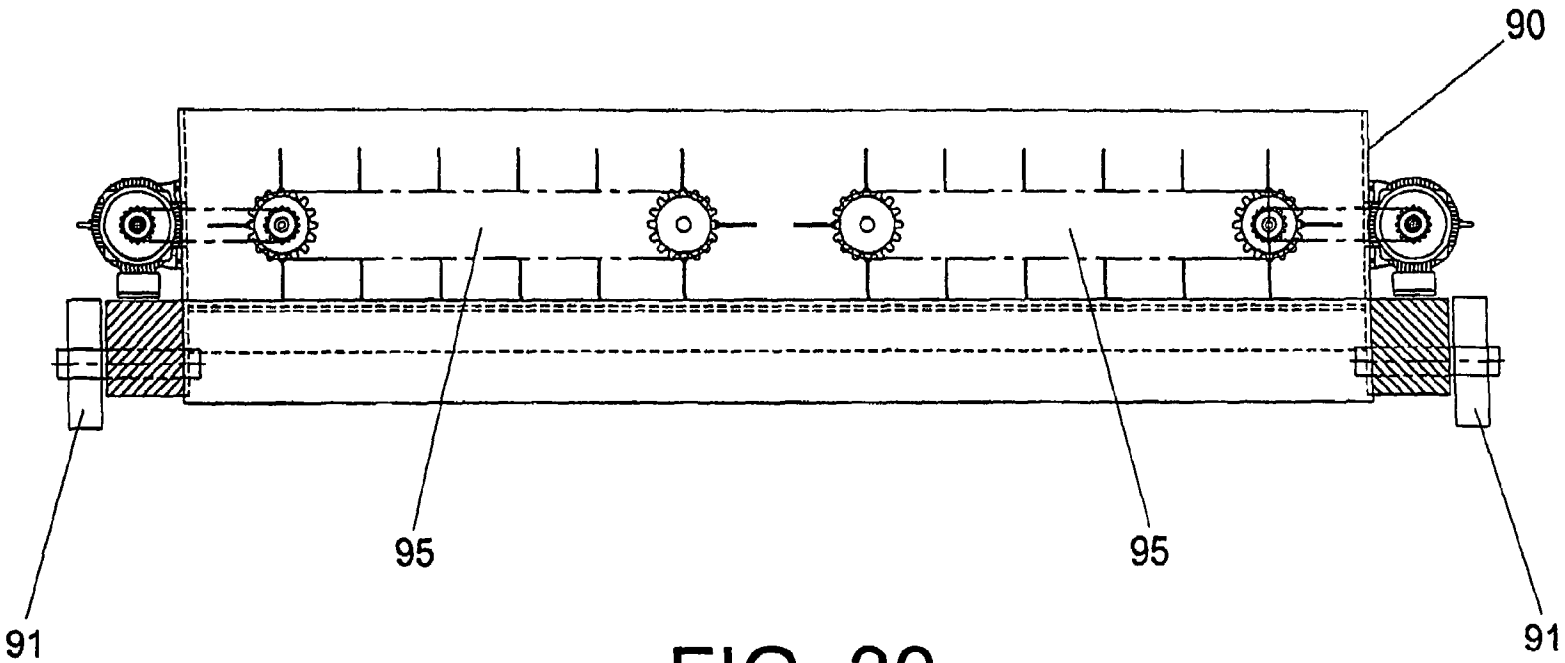
FIG. 30. Is a view in side elevation of that shown in FIG. 29.

As can be seen better in FIG. 27, the sliding framework 90 of the metering devices includes two cleaner rollers 97 and 98 at its ends in the front and rear part thereof. The inner cleaner rollers 98 are arranged obliquely in order to effect a better sweeping and smoothing of the layer poured into the mould. The outer cleaner rollers 97 are longer and sweep the horizontal surface that is going to make contact with the upper hot plate 47 of the press, preventing the formation of unwanted encrustations.

The sliding framework 90 includes some thrusters 99 at the front which withdraw the door cores 28 after the pressing and are raised higher up than the mouth of the mould by the action of the lower cylinders 61 of the press. At the same time as they are withdrawn the different mould units are charged according to a sequence of movements combined with the action of the cylinders that govern the admission of the product, as we will see further below.

Figure 25:
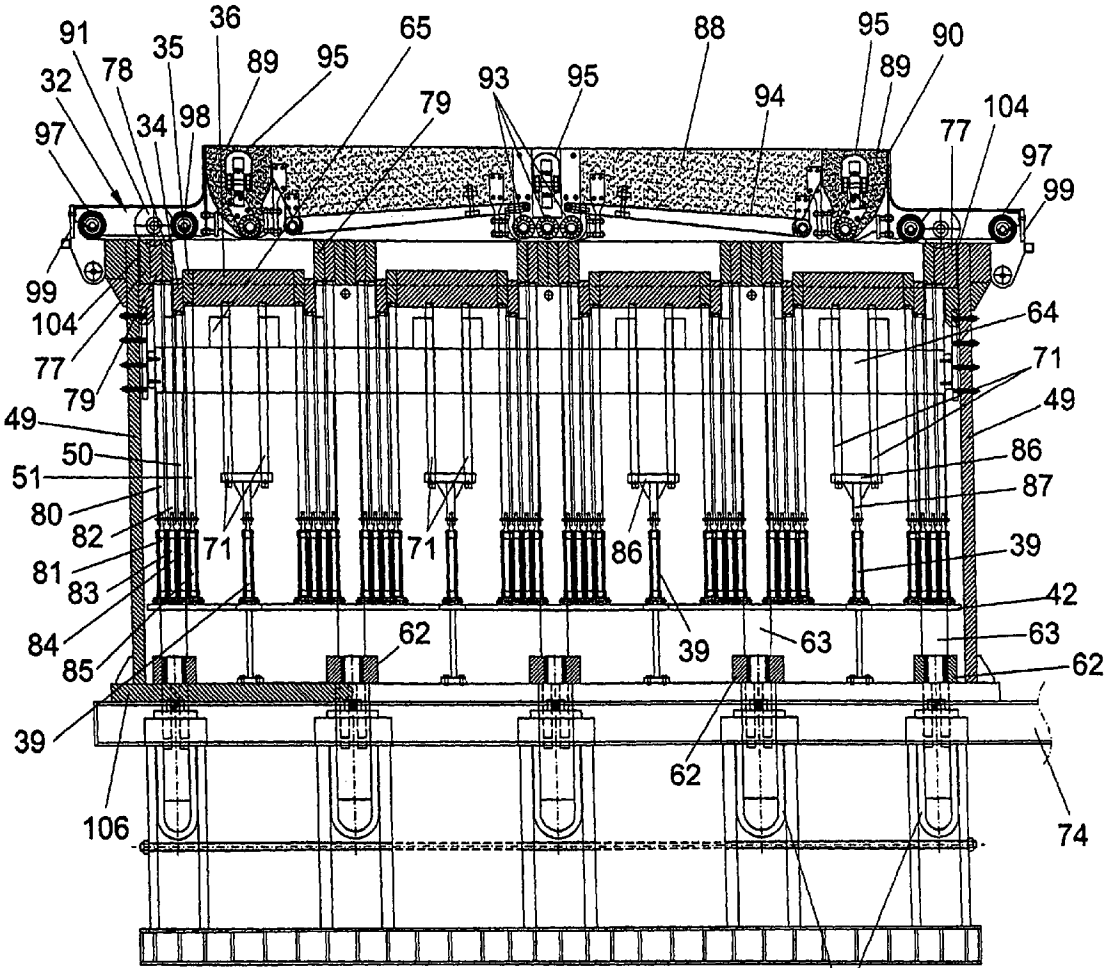
FIG. 25. Is a sectioned view in longitudinal elevation, similar to that shown in FIG. 18 but with the internal structure of the mould more simplified in accordance with the third form of embodiment of the present invention, in other words, without including moving frameworks with ramps for elevation and descent, since solely hydraulic cylinders are used.

If we look at FIG. 25, let us assume that the sliding framework 90 with the metering hoppers 88 and 89 are on the left (without entering into the mould) and when the pressing has already been done of the four door cores in this case and the upper plate 47 has been withdrawn from the press, by raising the lower cylinders 61 of the press, the stripping of the mould is produced. At this moment, when the carriage or framework 90 advances to the right the door cores 28 are withdrawn with the thruster 99 on the right. Simultaneously, the discharge takes place of product for the lower layer of the sandwich with the hopper 89 above the first unit of the composite mould. Next, this unit is filled with the material of the hopper 88 once the frameworks and metal strips (as the case might be) have descended in order to admit the middle layer of the sandwich while the second unit is being filled with the lower layer of it. In the following phase of the advance, the cylinders descend so that the upper layer of the first unit of the mould can be filled with the product from the hopper 89 on the left of the carriage or framework 90; the second and third unit are filled with the intermediate layer; the fourth unit is charged with the lower layer of the sandwich of the material from the first hopper 89. In this way, all the units are correctly filled as far as the right. When the sliding framework 90 exits from the mould and is located on the right of it, the upper hot plate of the press descends and the pressing takes place. In the return travel of the carriage (which is not such because it is an active travel), the different units of the mould are filled in the same way as mentioned above but in the reverse order and the pressed boards are simultaneously withdrawn, and so on successively.

Referring again to FIGS. 21 and 24, we can also see that represented in them are the heating circuits for metal strips 79, the inner moveable perimetric part 78, first and second frameworks 34 and 35 and pads or transverse portions (36, 37, 38) in order to be able to melt the glues mixed with the conglomerate wood particles. Owing to the ascending and descending movements, the access ducts 100 are rigid and vertical so that they can pass comfortably through openings 101 in the thrust platform 64 and then continue in flexible sections 102. Other ducts, such as those referenced with 103, also correspond to heating systems by means of steam or hot air for the transverse portions or pads (36, 37, 38) for the formation of void for paneling or glazing.

The outer fixed perimetric part 77 of the rectangular frame 32 determines a closed framework which is isolated from the peripheral wall 49 for support, by means of an isolating lamina 104.

When it is necessary to proceed to repair or clean the mould, as was considered in the previous embodiment, there exist means for raising the entire mould and fitting some wheels to it for mounting on the rails 74 in order to remove it from the press. In the case that we are concerned with, provision has been made for some lower pawls 105 to lift the supports 106 due to being linked to the lower bars 107, making contact by raising the lower cylinders 61 of the press by a greater amount, as can be deduced from observing FIG. 26.

The invention claimed is:

1. A mold for producing door cores, where the door cores are made of a material formed from wood and glue conglomerate particles in three layers forming a sandwich of a uniform thickness whose outer layers are made of smaller particles and of greater density to that of an inner layer which is thicker and made of larger particles, this material being supplied from respective formers for filling a mold and then being compressed between the hot plates of a press; where the inner layer in turn has a greater density in its periphery than in its central part for each door core obtained in a single pressing, where the periphery of the inner layer comprises spars, end cross-members and central cross-members, comprising:

a fixed perimeter frame following the contour of the door core or a multiple of the surface thereof in order to obtain several door cores simultaneously and separate them afterwards by cutting, the height of said perimeter frame being greater than the thickness of the door core prior to compacting;

a first rectangular framework for forming the periphery of the door core, whose surface includes as many apertures as there are door cores to obtain simultaneously, of smaller dimensions and in a concentric position with respect to them, the rectangular framework being hydraulically driven to be displaced from a lower position in which it will receive a product from the formers in an uncompacted thickness for filling the mold, up to a raised position for compacting the product which remains with the thickness corresponding to that of the standard doors;

at least one independent second rectangular framework which can be telescopically displaced inside each of the apertures of the first rectangular framework for forming the door core with its voids if there are any for panelling or glazing, also being driven by hydraulic cylinders and of the same height as the first rectangular framework;

an upper hot plate, vertically movable, which constitutes a hot plate of the press and which is also hydraulically driven in order to close the mold when contact is made with the fixed perimeter frame; and a lower horizontal platform that is movable vertically and is hydraulically driven, on which rests a first rectangular framework which is integral with it, fitted to the dimensions of the void of the perimeter frame and which can slide inside it in the manner of a plunger;

wherein the upper hot plate of the press and the first and second rectangular frameworks which materialize the lower hot plate thereof, on which the particles of conglomerate and glue lie, furthermore incorporate outlet nozzles for hot air or steam, as well as a heating system for melting the urea-formaldehyde glues.

2. The mold of claim 1, wherein the rectangular frame or perimeter wall has an internal hollow or aperture of dimensions corresponding to the door core to manufacture or various independent hollows or apertures for simultaneously obtaining various units in the same pressing phase, in each of which slides the first rectangular framework the useful surface of which defines the zone where a greater quantity of product is received, the second rectangular framework movable inside the first rectangular framework and a sliding block inside the second framework which is formed from a set of portions or pads of the same or different size which can be moved independently.

3. The mold of claim 2, wherein the rectangular frame or perimeter wall of the mold rests in a perimetric structure provided with wheels which slide on rails.

4. The mold of claim 2, wherein the first rectangular framework is supported on a set of vertical rods secured to a movable framework of adjustable height and which pass through an upper thrust platform driven by hydraulic cylinders which act on some lower metal strips and by means of intermediate support columns.

5. The mold of claim 4, wherein the movable framework of adjustable height from which emerge all the vertical rods include some wheels underneath them, which rest on respective ramps provided on a displaceable framework which in turn is supported on some wheels secured to supports fixed to the lower part of a perimetric structure of the support for the fixed frame of the mold and whose spars possess fixed to them a rack section connected to a respective pinion driven by a motor for the sliding of said displaceable framework towards one side or the other and thereby to vary the travel for admission and compaction of the product.

6. The mold of claim 4, wherein the second rectangular framework is supported on another set of vertical rods likewise secured to the movable framework of adjustable height and which pass through the upper thrust platform, being of greater length than the vertical rods for supporting the first rectangular framework in order to establish the difference in charge height.

7. The mold of claim 4, wherein the portions of the block sliding inside the second rectangular framework are transverse portions in the manner of independent pads, each one of which is supported on vertical rods likewise secured to the movable framework of adjustable height and which pass through the upper thrust platform, being of equal length to the vertical rods for supporting the second rectangular framework in order to acquire the same height and be flush with the latter, each transverse portion or independent pad being aided by the corresponding vertical cylinder of independent actuation, the casings of which rest on bars providing common support and whose rods traverse the upper thrust platform and are secured to the base of their respective independent pad, these bars being supported on support columns in the fixed base of the mold and being able to keep elevated the independent pads selected for being flush with the mouth of the mold and being maintained during the phase of charging and pressing in order to form the void or voids if there are any for panelling or glazing, with the predetermined distribution and size.

8. The mold of claim 2, wherein the second rectangular framework is supported on another set of vertical rods likewise secured to a movable framework of adjustable height and which pass through an upper thrust platform, being of greater length than the vertical rods for supporting the first rectangular framework in order to establish the difference in charge height.

9. The mold of claim 8, wherein the difference in charge height is adjustable in order to vary the density of pressing in this perimeter zone of the door core.

10. The mold of claim 9, wherein said adjustment is done by shims provided in the base of the vertical rods.

11. The mold of claim 8, wherein the portions of the block sliding inside the second rectangular framework are transverse portions in the manner of independent pads, each one of which is supported on vertical rods likewise secured to the movable framework of adjustable height and which pass through the upper thrust platform, being of equal length to the vertical rods for supporting the second rectangular framework in order to acquire the same height and be flush with the latter, each transverse portion or independent pad being aided by the corresponding vertical cylinder of independent actuation, the casings of which rest on bars providing common support and whose rods traverse the upper thrust platform and are secured to the base of their respective independent pad, these bars being supported on support columns in the fixed base of the mold and being able to keep elevated the independent pads selected for being flush with the mouth of the mold and being maintained during the phase of charging and pressing in order to form the void or voids if there are any for panelling or glazing, with the predetermined distribution and size.

12. The mold of claim 8, wherein the movable framework of adjustable height from which emerge all the vertical rods include some wheels underneath them, which rest on respective ramps provided on a displaceable framework which in turn is supported on some wheels secured to supports fixed to the lower part of the perimetric structure of the support for the fixed frame of the mold and whose spars possess fixed to them a rack section connected to the respective pinion driven by a motor for the sliding of said displaceable framework towards one side or the other and thereby to vary the travel for admission and compaction of the product.

13. The mold of claim 2, wherein the portions of the block sliding inside the second rectangular framework are transverse portions in the manner of independent pads, each one of which is supported on vertical rods likewise secured to the movable framework of adjustable height and which pass through the upper thrust platform, being of equal length to the vertical rods for supporting the second rectangular framework in order to acquire the same height and be flush with the latter, each transverse portion or independent pad being aided by the corresponding vertical cylinder of independent actuation, the casings of which rest on bars providing common support and whose rods traverse the upper thrust platform and are secured to the base of their respective independent pad, these bars being supported on support columns in the fixed base of the mold and being able to keep elevated the independent pads selected for being flush with the mouth of the mold and being maintained during the phase of charging and pressing in order to form the void or voids if there are any for panelling or glazing, with the predetermined distribution and size.

14. The mold of claim 13, wherein a movable framework of adjustable height from which emerge all the vertical rods include some wheels underneath them, which rest on respective ramps provided on a displaceable framework which in turn is supported on some wheels secured to supports fixed to the lower part of the perimetric structure of the support for the fixed frame of the mold and whose spars possess fixed to them a rack section connected to the respective pinion driven by a motor for the sliding of said displaceable framework towards one side or the other and thereby to vary the travel for admission and compaction of the product.

15. The mold of claim 2, wherein the pressing of the product received in three layers is produced with the action of hydraulic cylinders linked to the lower metal strips, there existing on upper thrust platform some thrusting pads of equal height and arranged in a position facing the first and second frameworks and the independent pads.

16. A mold for producing door cores, where the door cores are made of a material formed from wood and glue conglomerate particles in three layers forming a sandwich of a uniform thickness whose outer layers are made of smaller particles and of greater density to that of an inner layer which is thicker and made of larger particles, this material being supplied from respective formers for filling a mold and then being compressed between the hot plates of a press; where the inner layer in turn has a greater density in its periphery than in its central part for each door core obtained in a single pressing, where the periphery of the inner layer comprises spars, end cross-members and central cross-members, comprising:

a fixed perimeter frame following the contour of the door core or a multiple of the surface thereof in order to obtain several door cores simultaneously and separate them afterwards by cutting, the height of said perimeter frame being greater than the thickness of the door core prior to compacting;

a first rectangular framework for forming the periphery of the door core, whose surface includes as many apertures as there are door cores to obtain simultaneously, of smaller dimensions and in a concentric position with respect to them, the rectangular framework being hydraulically driven to be displaced from a lower position in which it will receive a product from the formers in an uncompacted thickness for filling the mold, up to a raised position for compacting the product which remains with the thickness corresponding to that of the standard doors;

at least one independent second rectangular framework which can be telescopically displaced inside each of the apertures of the first rectangular framework for forming the door core with its voids if there are any for panelling or glazing, also being driven by hydraulic cylinders and of the same height as the first rectangular framework;

an upper hot plate, vertically movable, which constitutes a hot plate of the press and which is also hydraulically driven in order to close the mold when contact is made with the fixed perimeter frame; and a lower horizontal platform that is movable vertically and is hydraulically driven, on which rests a first rectangular framework which is integral with it, fitted to the dimensions of the void of the perimeter frame and which can slide inside it in the manner of a plunger;

wherein the rectangular framework of greater height than the first and second rectangular frameworks comprises an outer fixed part, perimetric to each independent unit, and another movable inner part also perimetric and which can occupy two positions: an upper one which is maintained flush with the perimetric outer part in order to manufacture standard door cores and another lower position for the manufacture of door cores of larger dimensions in length and width, when it is dropped down by the same amount as the first rectangular framework in order to receive a greater volume of material to press;

wherein all the movable elements on which product can be deposited include circulation galleries for a heating fluid whose ducts comfortably pass through openings provided in a thrust platform.

17. A mold for producing door cores, where the door cores are made of a material formed from wood and glue conglomerate particles in three layers forming a sandwich of a uniform thickness whose outer layers are made of smaller particles and of greater density to that of an inner layer which is thicker and made of larger particles, this material being supplied from respective formers for filling a mold and then being compressed between the hot plates of a press; where the inner layer in turn has a greater density in its periphery than in its central part for each door core obtained in a single pressing, where the periphery of the inner layer comprises spars, end cross-members and central cross-members, comprising:

a fixed perimeter frame following the contour of the door core or a multiple of the surface thereof in order to obtain several door cores simultaneously and separate them afterwards by cutting, the height of said perimeter frame being greater than the thickness of the door core prior to compacting;

a first rectangular framework for forming the periphery of the door core, whose surface includes as many apertures as there are door cores to obtain simultaneously, of smaller dimensions and in a concentric position with respect to them, the rectangular framework being hydraulically driven to be displaced from a lower position in which it will receive a product from the formers in an uncompacted thickness for filling the mold, up to a raised position for compacting the product which remains with the thickness corresponding to that of the standard doors;

at least one independent second rectangular framework which can be telescopically displaced inside each of the apertures of the first rectangular framework for forming the door core with its voids if there are any for panelling or glazing, also being driven by hydraulic cylinders and of the same height as the first rectangular framework;

an upper hot plate, vertically movable, which constitutes a hot plate of the press and which is also hydraulically driven in order to close the mold when contact is made with the fixed perimeter frame; and a lower horizontal platform that is movable vertically and is hydraulically driven, on which rests a first rectangular framework which is integral with it, fitted to the dimensions of the void of the perimeter frame and which can slide inside it in the manner of a plunger;

wherein the rectangular framework of greater height than the first and second rectangular frameworks comprises an outer fixed part, perimetric to each independent unit, and another movable inner part also perimetric and which can occupy two positions: an upper one which is maintained flush with the perimetric outer part in order to manufacture standard door cores and another lower position for the manufacture of door cores of larger dimensions in length and width, when it is dropped down by the same amount as the first rectangular framework in order to receive a greater volume of material to press;

wherein metering hoppers with the two types of material of the sandwich are mounted on a sliding framework, with outer or side hoppers of the metering hoppers containing the type of product for the outer layers of the sandwich, while the product for the intermediate layer thereof is located in a central hopper of the metering hoppers, which is of larger size than the side hoppers, said product being discharged by rotating rollers with blades, these rollers being located in the lower part of those metering hoppers and there existing some cleaner rollers in the initial and rear part of said sliding framework.

18. The mold of claim 17, wherein the cleaner rollers are double, inner ones of the cleaner rollers being arranged obliquely and being of lesser length for sweeping and levelling the layer of product that has been poured, while outer rollers of the cleaner rollers are of greater length in order to clean the seating or surface for perimetric contact with the upper hot plate of the press.

19. The mold of claim 17, wherein there are three rotating rollers of the central metering hopper: a central one and two outer ones which distribute the product of the middle layer of the sandwich that lies on them, transported on side conveyor belts which advance longitudinally towards the center and an upper device for uniform distribution.

20. The mold of claim 19, wherein the upper device for uniform distribution includes two flight conveyors which advance transversely.

* * * * *